US008739587B2

(12) United States Patent
Chen

(10) Patent No.: US 8,739,587 B2
(45) Date of Patent: Jun. 3, 2014

(54) REKEYABLE LOCK ASSEMBLY WITH BLOWN CYLINDER PROTECTION

(75) Inventor: Henry Chen, Xiamen (CN)

(73) Assignee: Kwikset Corporation, Foothill Ranch, CA (US)

( * ) Notice: Subject to any disclaimer, the term of this patent is extended or adjusted under 35 U.S.C. 154(b) by 483 days.

(21) Appl. No.: 12/543,475

(22) Filed: Aug. 18, 2009

(65) Prior Publication Data

US 2011/0041579 A1 Feb. 24, 2011

(51) Int. Cl.
*E05B 27/04* (2006.01)
*E05B 29/04* (2006.01)

(52) U.S. Cl.
USPC ..... 70/492; 70/383; 70/384; 70/493; 70/495

(58) Field of Classification Search
USPC ..... 70/491–493, 495, 496, 388, 414, 70/337–343, 368, 382–385, 419, 421, 358, 70/392, 376–378, DIG. 22, DIG. 23, 70/DIG. 25
See application file for complete search history.

(56) References Cited

U.S. PATENT DOCUMENTS

| | | | | | |
|---|---|---|---|---|---|
| 1,137,803 | A | * | 5/1915 | Sparks | 70/340 |
| 1,738,105 | A | * | 12/1929 | Jacobi | 70/388 |
| 1,965,889 | A | * | 7/1934 | Fitz | 70/419 |
| 1,977,189 | A | | 10/1934 | Larson | |
| 2,036,747 | A | * | 4/1936 | Fitz | 70/496 |
| 2,049,548 | A | | 8/1936 | Swanson | |
| 2,426,104 | A | * | 8/1947 | Johnstone | 70/421 |
| 2,431,894 | A | * | 12/1947 | Spain | 70/490 |
| 2,641,920 | A | * | 6/1953 | Gill et al. | 70/388 |
| 2,690,070 | A | * | 9/1954 | Spain | 70/421 |
| 2,879,658 | A | * | 3/1959 | Johnstone | 70/495 |
| 3,078,706 | A | * | 2/1963 | Russell | 70/419 |
| 3,137,156 | A | | 6/1964 | Navarro | |
| 3,326,024 | A | * | 6/1967 | Dreyfus et al. | 70/351 |
| 3,485,068 | A | * | 12/1969 | Bennett | 70/360 |
| 3,486,353 | A | * | 12/1969 | Pilvet | 70/496 |
| 3,492,843 | A | * | 2/1970 | Slaybaugh et al. | 70/388 |
| 3,507,133 | A | * | 4/1970 | Basseches | 70/421 |
| 3,552,160 | A | * | 1/1971 | Kleebauer | 70/388 |
| 3,599,455 | A | * | 8/1971 | Pilvet | 70/123 |
| 3,604,231 | A | * | 9/1971 | Buschi | 70/496 |
| 3,733,863 | A | * | 5/1973 | Toepfer | 70/496 |
| 3,928,992 | A | | 12/1975 | Talbot | |
| 3,990,282 | A | * | 11/1976 | Sorum | 70/495 |
| 4,376,382 | A | * | 3/1983 | Raymond et al. | 70/338 |
| 4,446,709 | A | * | 5/1984 | Steinbach | 70/496 |
| 4,471,638 | A | | 9/1984 | Scheerhorn | |
| 4,570,355 | A | | 2/1986 | De Forrest | |
| 4,635,453 | A | | 1/1987 | Hart | |
| 4,667,493 | A | | 5/1987 | Takahashi | |
| 4,703,638 | A | | 11/1987 | Bergstrom | |
| 4,712,402 | A | | 12/1987 | Monahan | |
| 4,836,002 | A | | 6/1989 | Monahan | |
| 4,850,210 | A | | 7/1989 | Adler et al. | |
| 4,920,774 | A | | 5/1990 | Martin | |
| 5,010,754 | A | | 4/1991 | De Angelo et al. | |

(Continued)

*Primary Examiner* — Lloyd Gall
(74) *Attorney, Agent, or Firm* — Barnes & Thornburg LLP

(57) ABSTRACT

A rekeyable lock cylinder includes a plug body with a keyway opening along a longitudinal axis and a multiple of channels transverse to the axis. A locking bar generally parallel to the longitudinal axis, the locking bar having an extension. A slide movably mounted to an end section of the plug body, the slide having a slot which selectively permits passage of the extension during a rekeying procedure.

12 Claims, 40 Drawing Sheets

(56) References Cited

U.S. PATENT DOCUMENTS

| | | | | |
|---|---|---|---|---|
| 5,077,994 | A | 1/1992 | Trull et al. | |
| 5,325,690 | A | 7/1994 | Adler et al. | |
| 5,540,071 | A | 7/1996 | Reikher | |
| 5,542,274 | A * | 8/1996 | Thordmark et al. | 70/495 |
| 5,749,253 | A | 5/1998 | Glick et al. | |
| 5,791,181 | A * | 8/1998 | Sperber et al. | 70/383 |
| 5,823,027 | A | 10/1998 | Glick et al. | |
| 5,848,541 | A | 12/1998 | Glick et al. | |
| 5,884,512 | A | 3/1999 | Wayne | |
| 6,064,316 | A | 5/2000 | Glick et al. | |
| 6,079,240 | A | 6/2000 | Shvarts | |
| 6,119,495 | A * | 9/2000 | Loreti | 70/340 |
| 6,301,942 | B1 | 10/2001 | Shvarts | |
| 6,474,118 | B2 | 11/2002 | Martinez | |
| 6,477,875 | B2 * | 11/2002 | Field et al. | 70/491 |
| 6,516,644 | B1 | 2/2003 | Seliber | |
| 6,745,603 | B1 | 6/2004 | Shaw | |
| 6,860,131 | B2 | 3/2005 | Armstrong et al. | |
| 6,862,909 | B2 | 3/2005 | Armstrong et al. | |
| 6,871,520 | B2 | 3/2005 | Armstrong et al. | |
| 6,889,533 | B2 | 5/2005 | Fuller | |
| 6,945,082 | B2 * | 9/2005 | Field et al. | 70/409 |
| 7,100,408 | B2 | 9/2006 | Nakasone | |
| 7,100,409 | B2 | 9/2006 | Chang | |
| 7,104,098 | B2 | 9/2006 | Romero et al. | |
| 7,114,357 | B2 | 10/2006 | Armstrong et al. | |
| 7,117,701 | B2 | 10/2006 | Armstrong et al. | |
| 7,131,004 | B1 | 10/2006 | Lyle | |
| 7,213,429 | B2 | 5/2007 | Armstrong et al. | |
| 7,234,331 | B2 | 6/2007 | Armstrong et al. | |
| 7,295,578 | B1 | 11/2007 | Lyle et al. | |
| 7,308,811 | B2 | 12/2007 | Armstrong et al. | |
| 7,322,219 | B2 | 1/2008 | Armstrong et al. | |
| 7,412,053 | B1 | 8/2008 | Lyle | |
| 7,434,431 | B2 | 10/2008 | Armstrong et al. | |
| 7,448,239 | B1 * | 11/2008 | Huang et al. | 70/360 |
| 7,448,240 | B1 * | 11/2008 | Huang et al. | 70/492 |
| 7,475,579 | B2 * | 1/2009 | Miao | 70/496 |
| 7,558,326 | B1 | 7/2009 | Lyle et al. | |
| 7,797,973 | B2 * | 9/2010 | Field et al. | 70/337 |
| 7,900,491 | B2 * | 3/2011 | Chong | 70/492 |
| 2004/0237612 | A1 | 12/2004 | Nugent | |
| 2008/0276673 | A1 * | 11/2008 | Huang et al. | 70/490 |
| 2009/0277240 | A1 * | 11/2009 | Huang et al. | 70/493 |
| 2011/0154872 | A1 * | 6/2011 | Huang et al. | 70/384 |

* cited by examiner

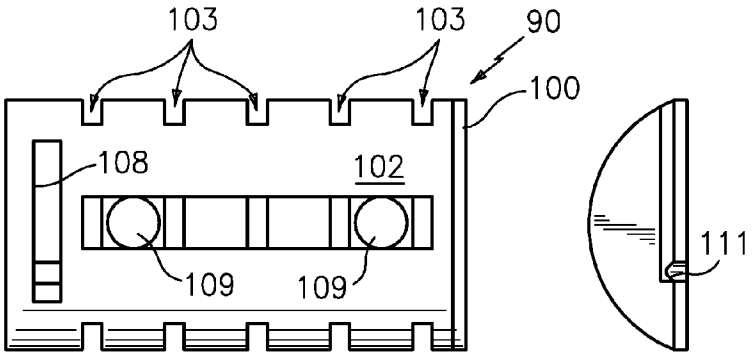
FIG. 17C
FIG. 17D
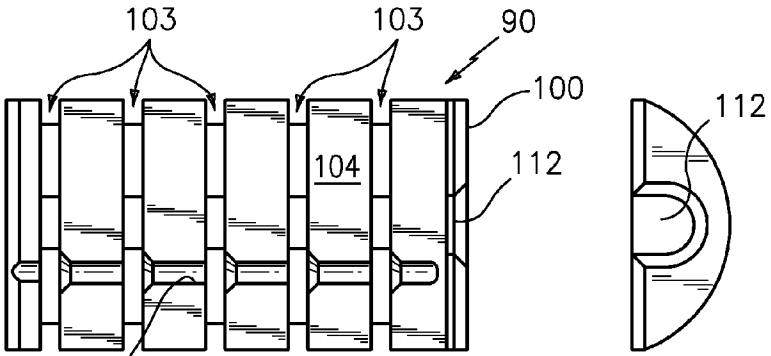
FIG. 17A
FIG. 17B
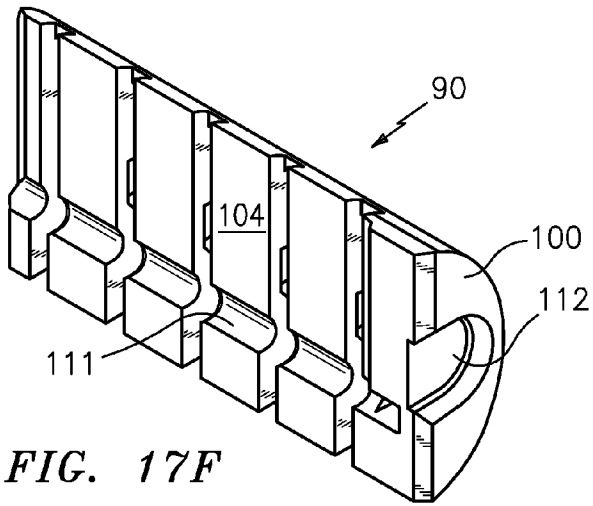
FIG. 17F
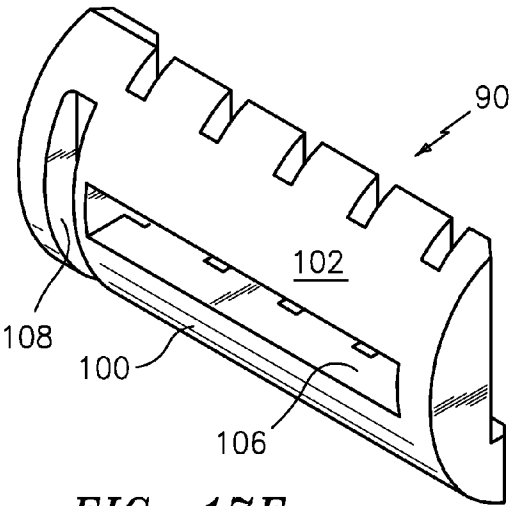
FIG. 17E

REKEYABLE LOCK ASSEMBLY WITH BLOWN CYLINDER PROTECTION

BACKGROUND

The present disclosure relates to rekeyable lock cylinders.

When rekeying a cylinder using a traditional cylinder design, the cylinder plug is removed from the cylinder body and the appropriate pins are replaced so that a new key can be used to unlock the cylinder. This typically requires removal of the cylinder mechanism from the lockset and disassembly of the cylinder to some degree to remove the plug and replace the pins. This requires a working knowledge of the lockset and cylinder mechanism. Additionally, the process usually employs special tools and requires access to pinning kits to interchange pins and replace components that may become lost or damaged in the rekeying process.

Some rekeyable cylinder designs utilize the familiar experience of rotating the key in the lock cylinder such that no special knowledge, training, or tools to rekey the lock cylinder are required. In some instances, however, the cylinder is rotated before the new key is fully inserted. This may result in a mismatch between the new key and the plug and is referred to as a "blown cylinder."

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIGS. 17A-17F are various views of the carrier for use in the present invention.

DETAILED DESCRIPTION

Figure 1:
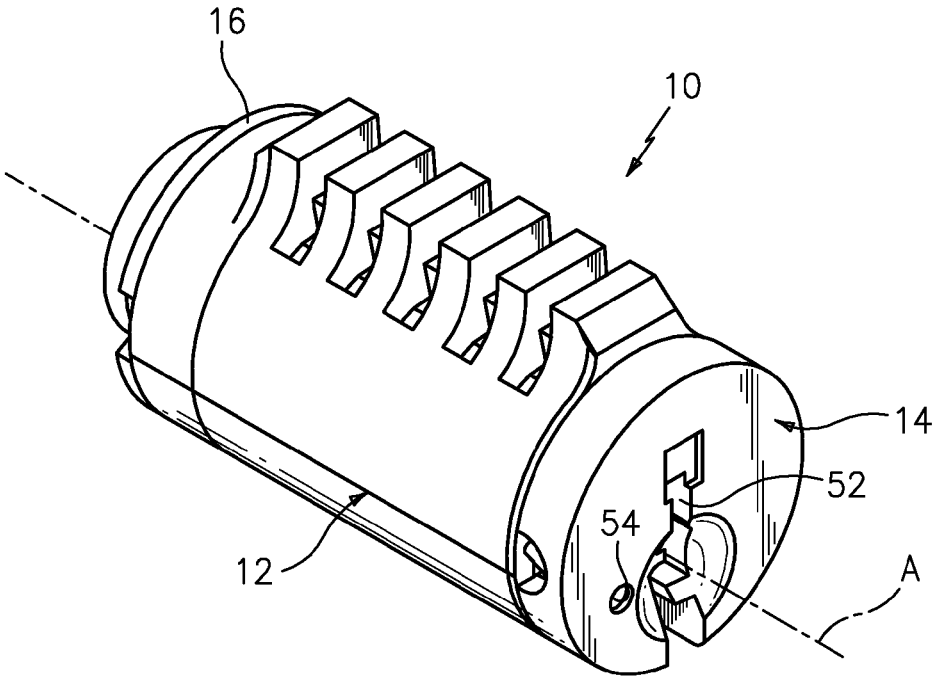
FIG. 1 illustrates a lock cylinder according to the present invention.
Figure 2:
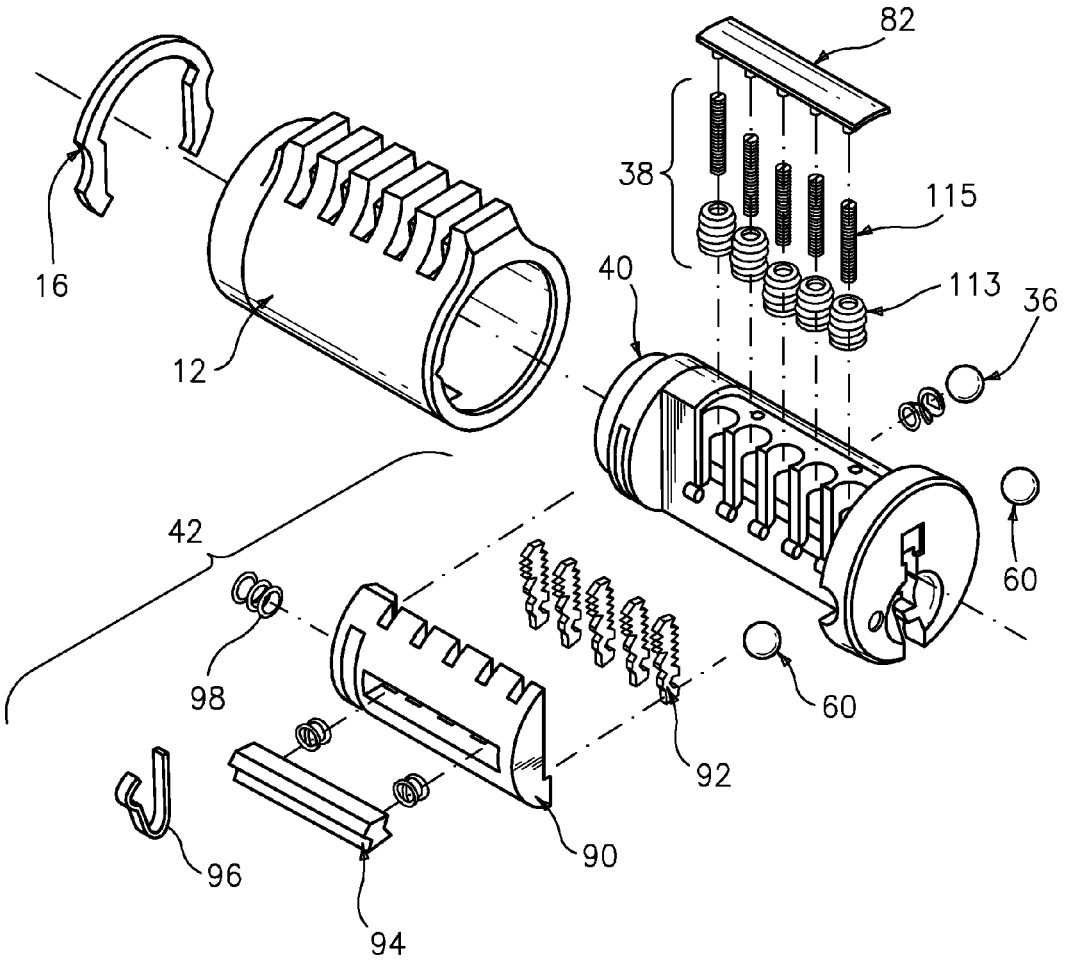
FIG. 2 is an exploded view of the lock cylinder of FIG. 1.

A lock cylinder 10 according to one non-limiting embodiment of the present disclosure is illustrated in FIGS. 1 and 2. The lock cylinder 10 includes a longitudinal axis A, a cylinder body 12, a plug assembly 14 and a retainer 16. In FIG. 1, the plug assembly 14 is in a home position relative to the cylinder body 12. The lock cylinder 10 of the present disclosure is operable with any conventional locking mechanism including, but not limited to, handlesets, knobsets, leversets, and even padlocks.

The cylinder body 12, as seen in FIGS. 15A-15E, includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32. The generally V-shaped locking bar-engaging groove 29 extends longitudinally along a portion of the cylinder body 12 from the front end 22. The first detent recess 30 is disposed at the back end 24 and extends to a first depth. The second detent recess 32 is disposed adjacent the first detent recess 30 and extends to a lesser depth. A detent bore 34 extends radially through the cylinder wall 26 for receiving a detent ball 36 (FIG. 2).

Figure 20A:
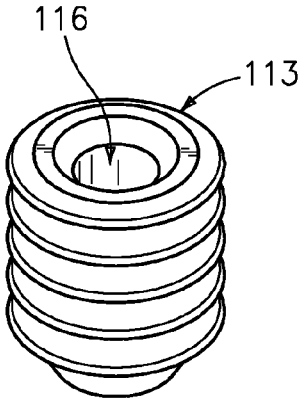
FIGS. 20A-20B are views of a pin for use in the present invention.
Figure 20B:
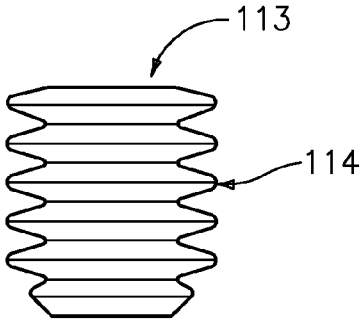

Referring to FIG. 2, the plug assembly 14 includes a plug body 40, a carrier sub-assembly 42 and a plurality of spring-loaded pins 38 (FIGS. 20A and 20B). The plug body 40, illustrated in FIGS. 16A-16F, includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60. The drive portion 50 includes an annular wall 62 with a pair of opposed projections 64 (FIG. 16E) extending radially inwardly to drive a spindle or torque blade (neither shown). The drive portion 50 further includes a pair of slots 66 formed in its perimeter for receiving the retainer 16 to retain the plug body 40 in the cylinder body 12.

The intermediate portion 46 includes a main portion 70 formed as a cylinder section having a first longitudinal planar surface 72 and a plurality of channels 74 transverse to the axis A for receiving the spring-loaded pins 38. The channels 74 extend transversely to the longitudinal axis of the plug body 40 and parallel to the planar surface 72. A second planar surface 76 extends perpendicular to the first planar surface 72 and defines a recess 80 for receiving a retaining cap 82 (FIGS. 22A-22D). The channels 74 extend from the second planar surface 76 partially through the plug body 40, with the sidewalls of the channels open to the first planar surface 72. The first planar surface 72 further includes a plurality of bullet-shaped, rack-engaging features 78. A bore 86 for receiving a spring-loaded detent ball 36 extends radially inwardly from opposite the first planar surface 72.

Figure 6:
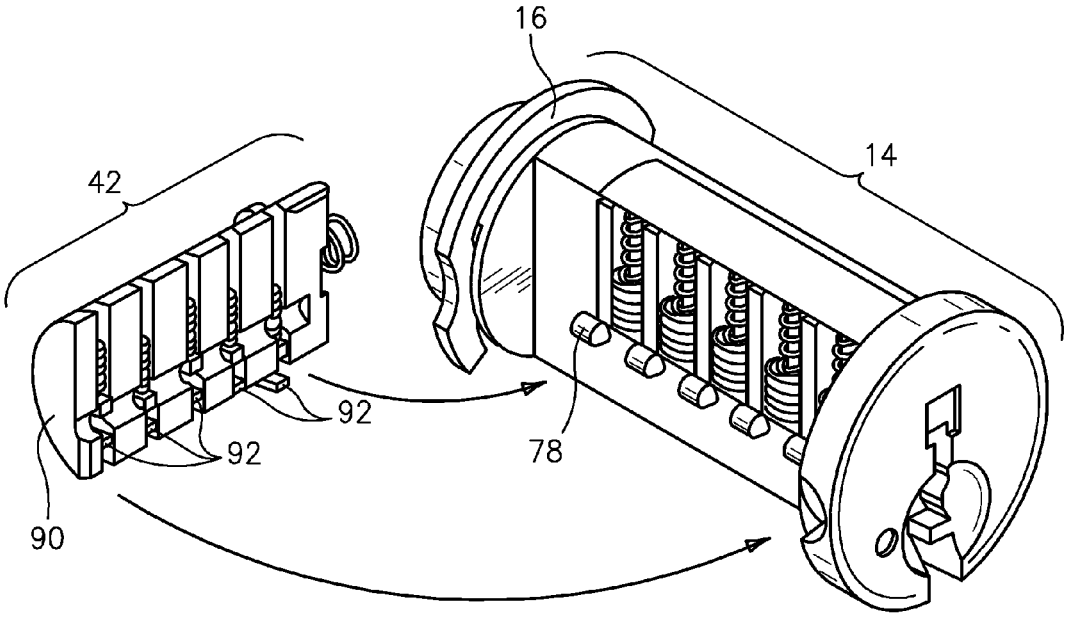
FIG. 6 is a partially exploded view of the plug assembly of FIG. 3.
Figure 10:
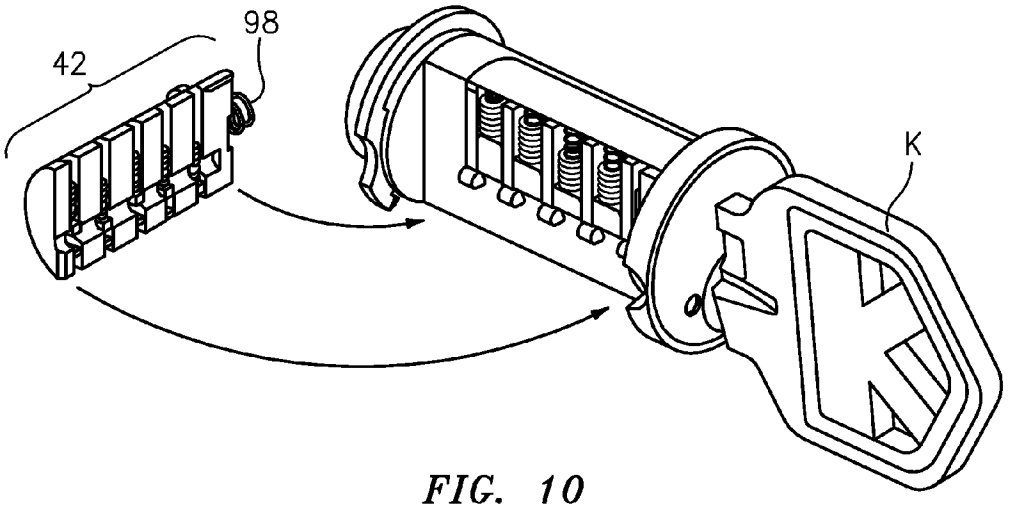
FIG. 10 is a partially broken away side view of the plug assembly of FIG. 8.
Figure 11:
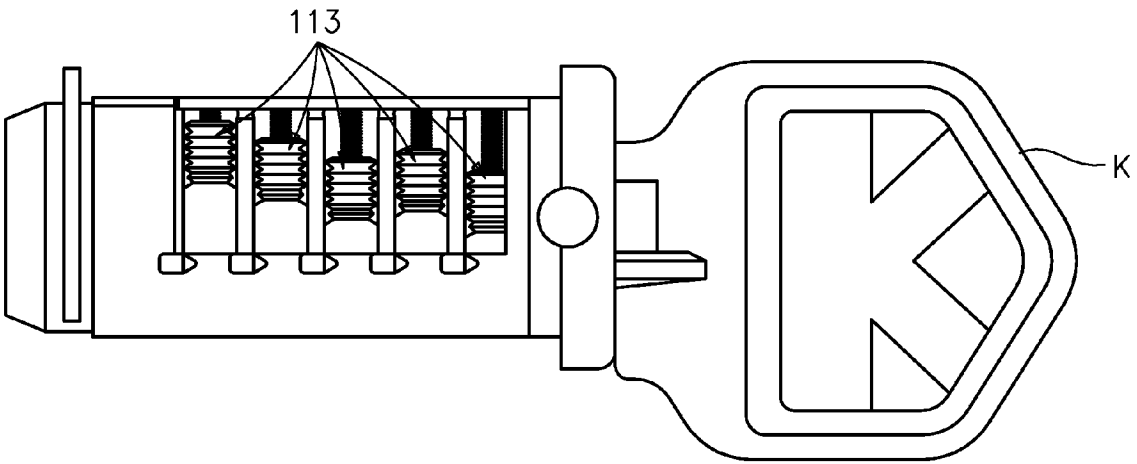
FIG. 11 is a partially exploded view of the plug assembly of FIG. 8.
Figure 18A:
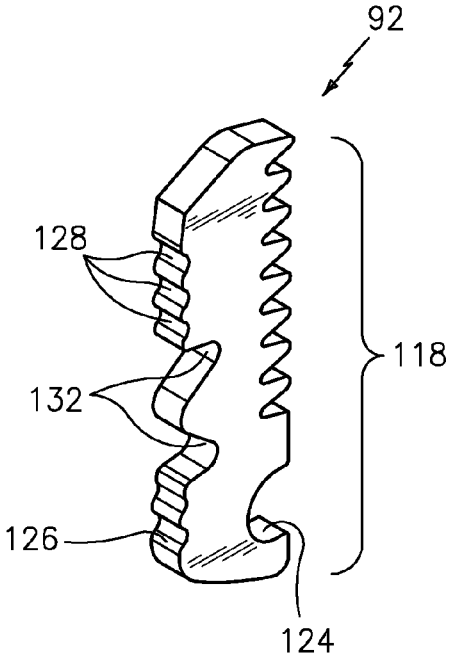
FIGS. 18A-18B are views of a rack for use in the present invention.
Figure 18B:
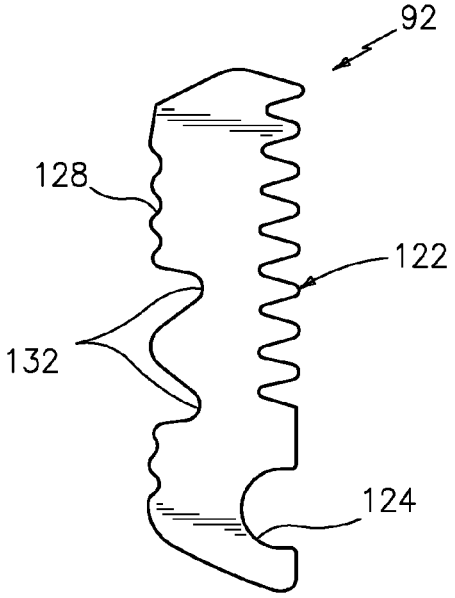
Figure 19A:
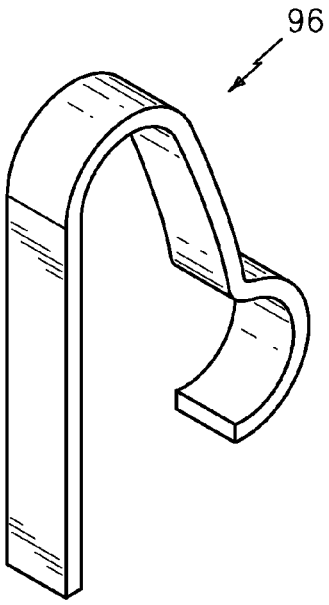
FIGS. 19A-19B are views of a spring catch for use in the present invention.
Figure 19B:
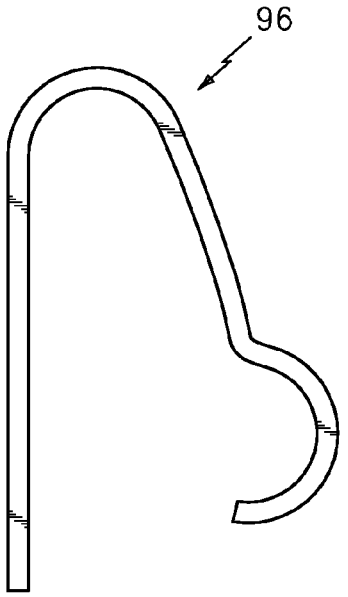
Figure 21B:
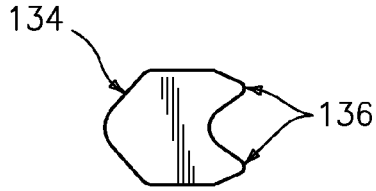
FIGS. 21A-21B are views of a locking bar for use in the present invention.

The carrier sub-assembly 42 (FIGS. 6 and 10) includes a carrier 90 (FIGS. 17A-17E), a plurality of racks 92 (FIGS. 18A-18B), a spring catch 96 (FIGS. 19A and 19B), a spring-loaded locking bar 94 (FIGS. 21A and 21B), and a return spring 98. The carrier 90 includes a body 100 in the form of a cylinder section that is complementary to the main portion 70 of the plug body 40, such that the carrier 90 and the main portion 70 combine to form a cylinder that fits inside the cylinder body 12. The carrier 90 includes a curved surface and a flat surface 104. The curved surface includes a locking bar recess 106 and a spring catch recess 108. The locking bar recess 106 further includes a pair of return spring-receiving bores 109 (17C) for receiving the locking bar return springs. The flat surface 104 includes a plurality of parallel rack-receiving slots 103 extending perpendicular to the longitudinal axis A of the carrier 90. A semi-circular recess 111 extends along the flat surface 104 parallel to the longitudinal axis of the carrier 90. The back end of the carrier 90 includes a recess 112 to receive the return spring 98.

Figure 7:
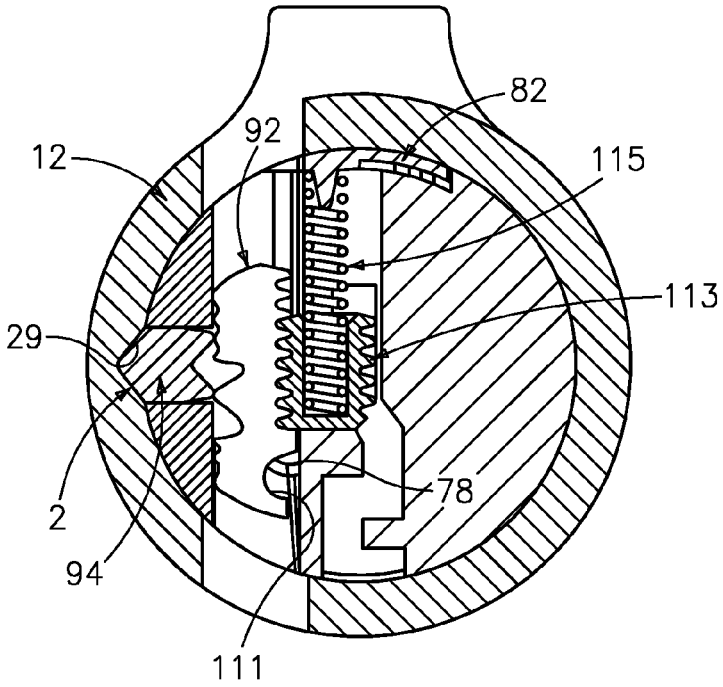
FIG. 7 is a section view through the plug assembly of FIG. 3 and a cylinder body, the section being taken transversely at one of the pins and illustrating the positioning of the pin, a rack, and the locking bar relative to each other and the cylinder body in a locked configuration.
Figure 12:
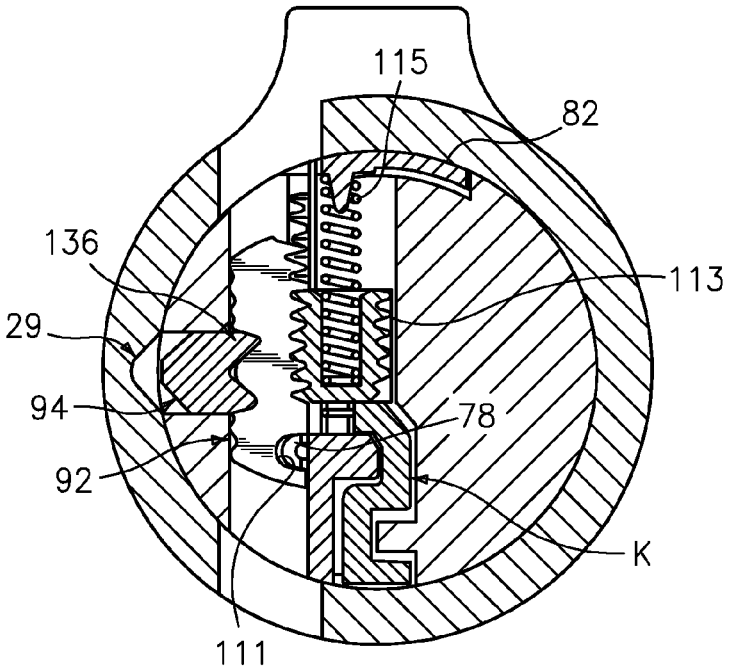
FIG. 12 is a section view through the plug assembly of FIG. 8 and a cylinder body, the section being taken transversely at one of the pins and illustrating the positioning of the pin, the rack, and the locking bar relative to each other and the cylinder body in an unlocked configuration.

Each spring-loaded pin 38 includes a pin 113 and a biasing spring 115. The pins 113, illustrated in FIGS. 20A and 20B, are generally cylindrical with annular gear teeth 114 and a central longitudinal bore 116 for receiving biasing springs 115. The racks 92, illustrated in FIGS. 18A and 18B, include a pin-engaging surface 118 having a plurality of gear teeth 122 configured to engage the annular gear teeth 114 on the pins 113, as illustrated in FIGS. 7 and 12, and a semi-circular recess 124 for engaging the bullet-shaped, rack-engaging features 78 on the planar surface 72, as illustrated in FIG. 12. The racks 92 further include a second surface 126 that includes a plurality of anti-pick grooves 128 and a pair of locking bar-engaging grooves 132.

Figure 21A:
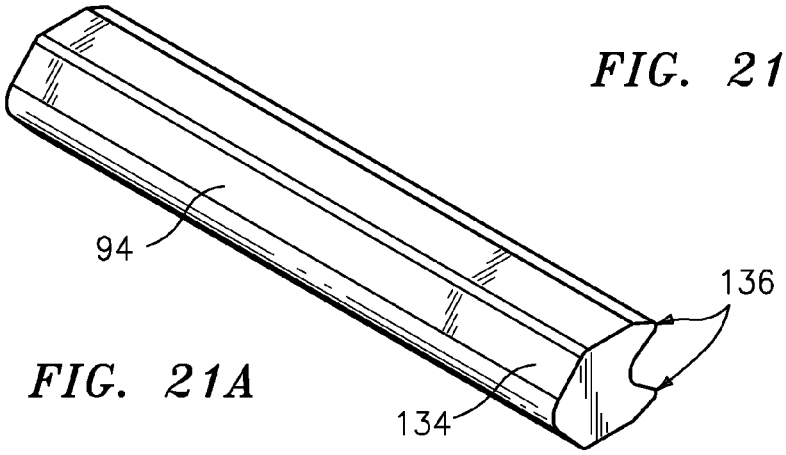
Figure 22A:
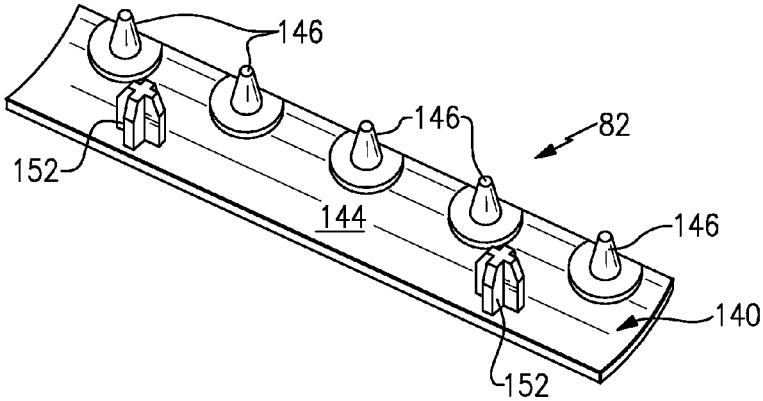
FIGS. 22A-22D are views of a spring retaining cap for use in the present invention.
Figure 22B:
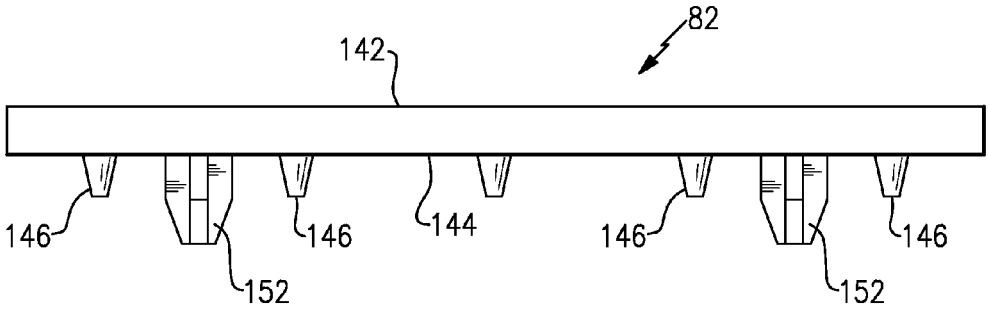
Figure 22C:
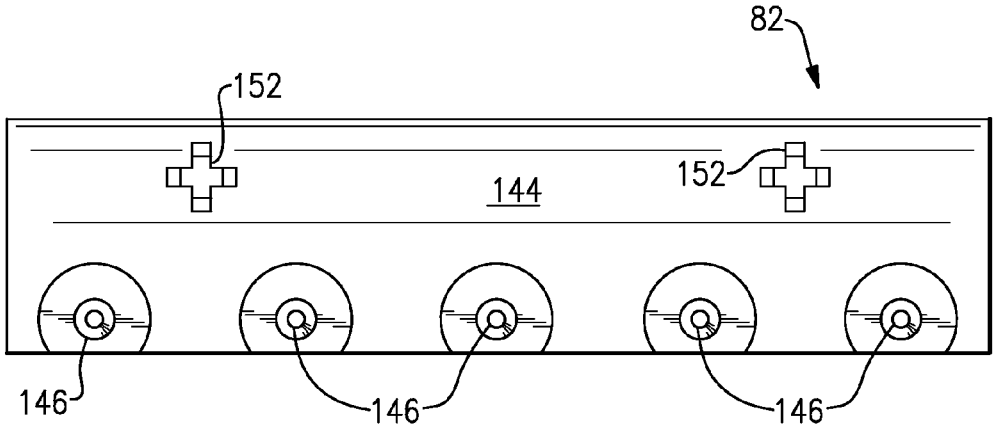
Figure 22D:
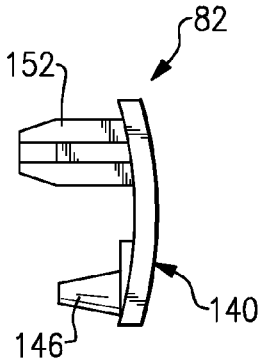
Figure 23:
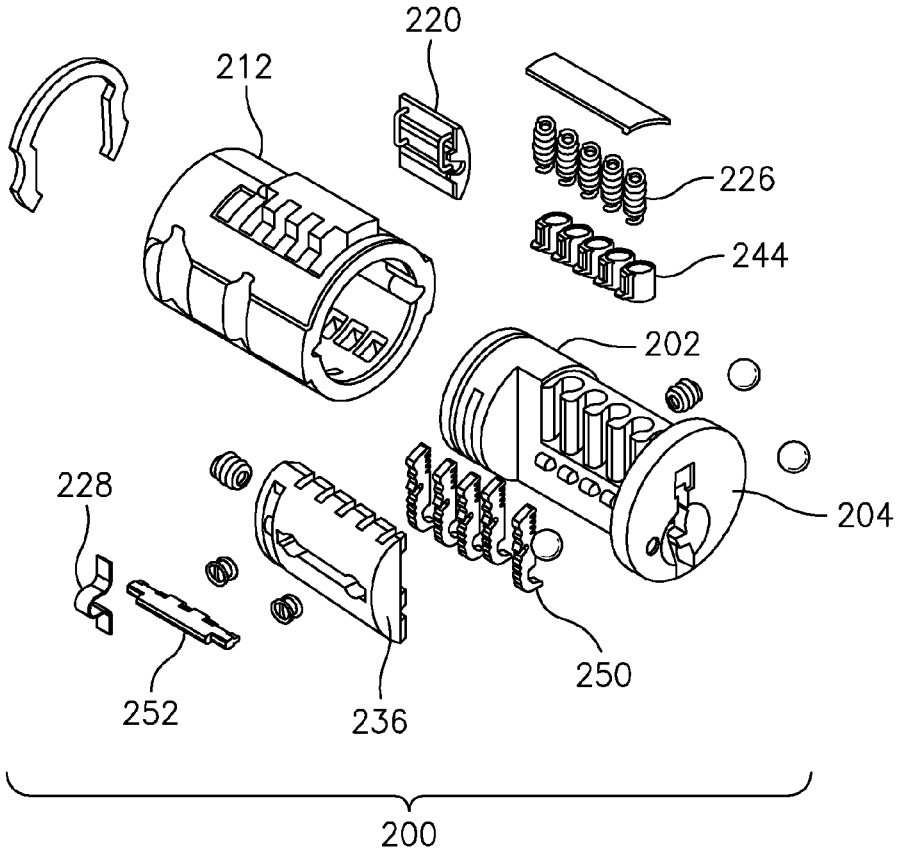
FIG. 23 is an exploded perspective view of an alternative embodiment of the invention.
Figure 24A:
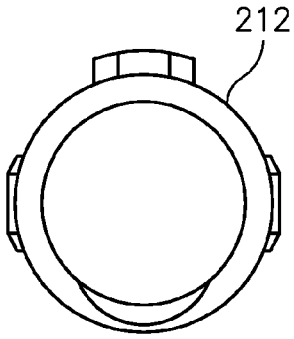
FIGS. 24A-24E are views of an alternative embodiment of the lock cylinder housing.
Figure 24B:
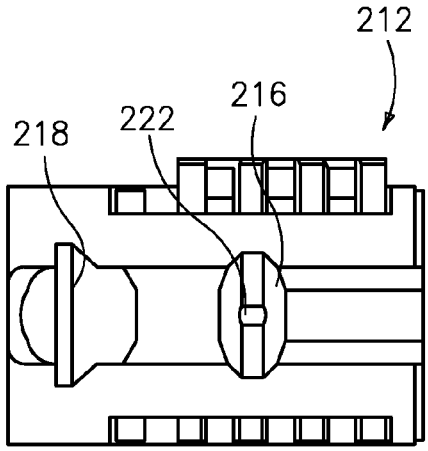
Figure 24C:
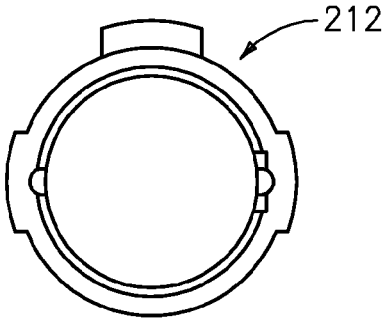
Figure 24D:
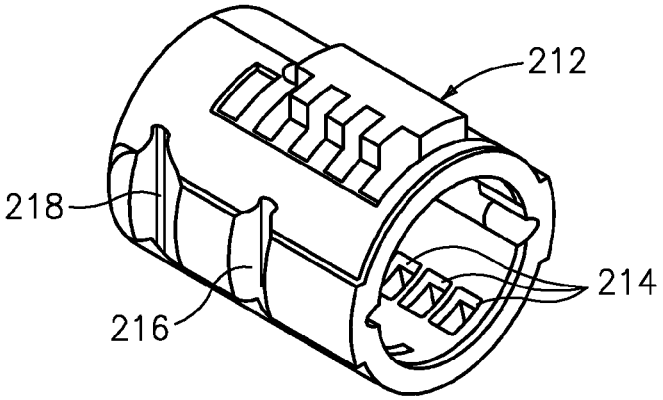
Figure 24E:
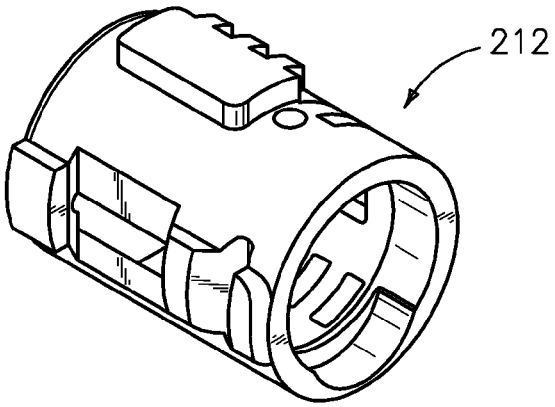
Figure 25:
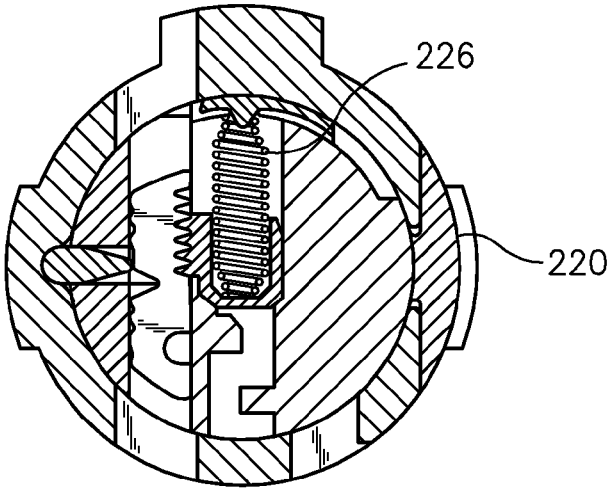
FIG. 25 is a transverse section view taken through an alternative embodiment of the present disclosure.
Figure 26A:
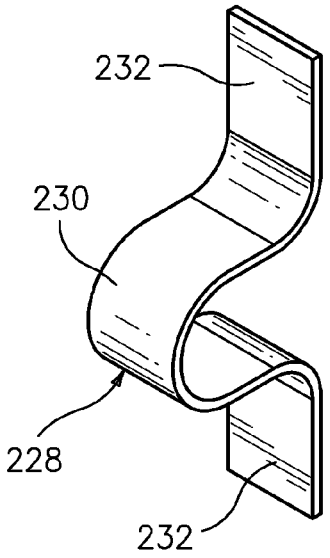
FIGS. 26A-26B are views of an alternative embodiment of the spring catch.
Figure 26B:
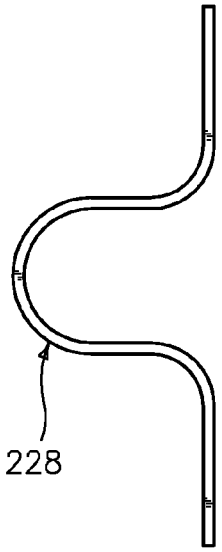

The spring-loaded locking bar 94, illustrated in FIGS. 21A and 22B, is sized and configured to fit in the locking bar recess 106 in the carrier 90 and includes a triangular edge 134 configured to fit in the V-shaped locking bar-engaging groove 29. Opposite the triangular edge 134, the locking bar 94 includes a pair of longitudinally extending gear teeth 136 configured to engage the locking bar-engaging grooves 132 formed in the racks 92, as illustrated in FIG. 12.

Figure 16A:
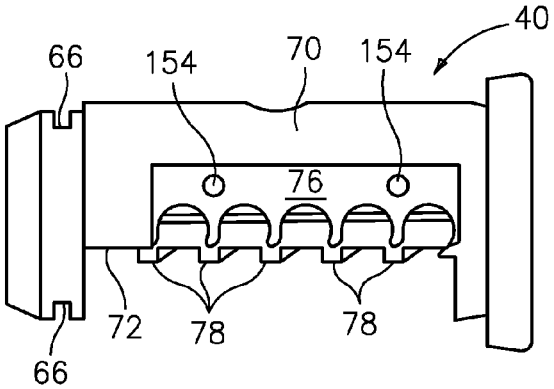
FIGS. 16A-16F are various views of the cylinder plug body for use in the present invention.
Figure 16B:
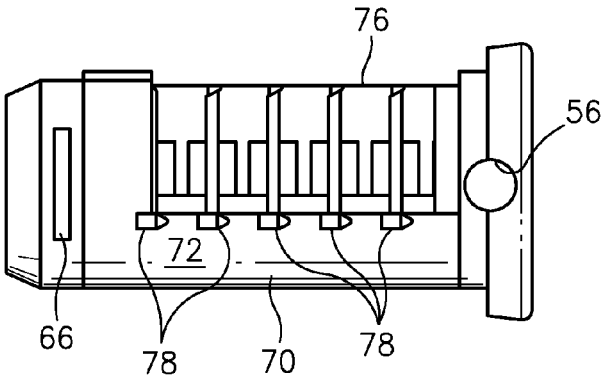
Figure 16C:
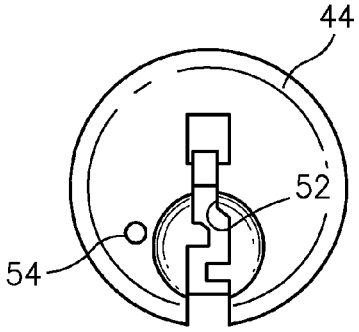
Figure 16D:
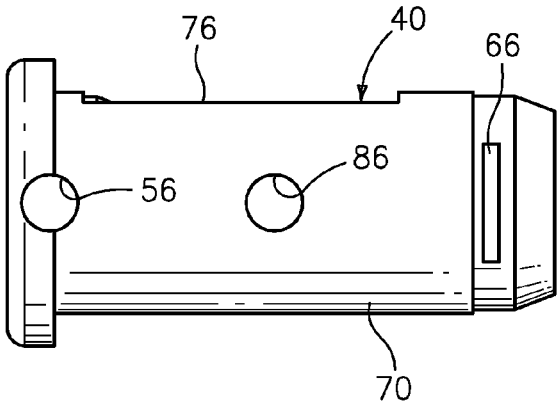
Figure 16F:
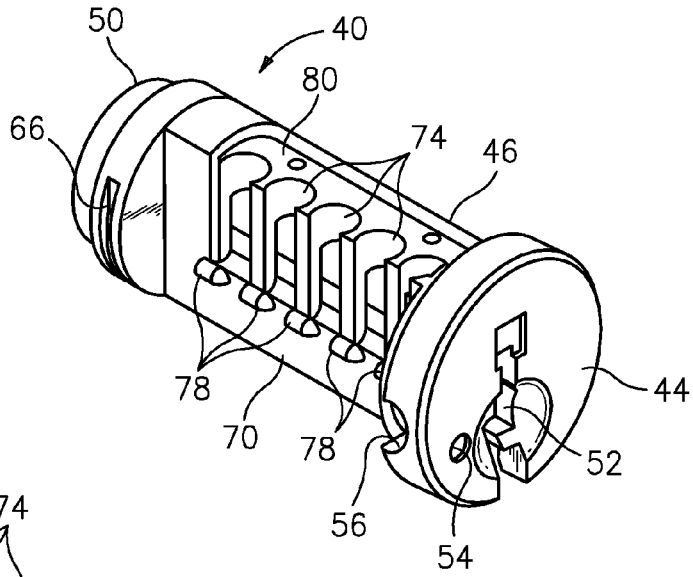
Figure 16E:
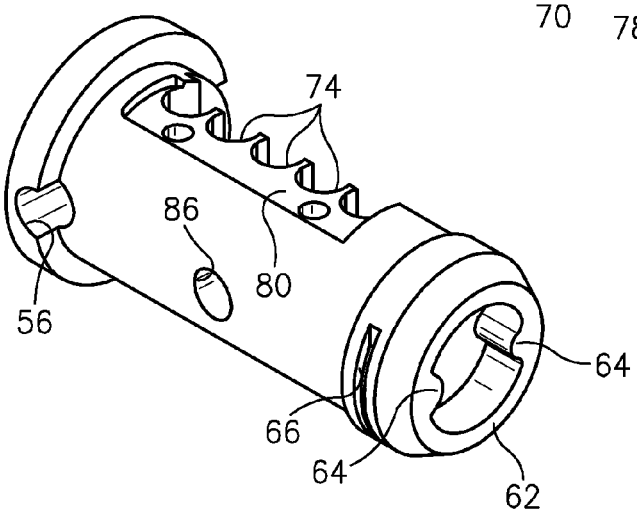

The spring-retaining cap 82, illustrated in FIGS. 22A-22D, includes a curvilinear portion 140 having an upper surface 142 and a lower surface 144. The thickness of the curvilinear portion 140 is set to allow the curvilinear portion 140 to fit in the recess 80 with the upper surface 142 flush with the intermediate portion 46 of the plug body 40, as illustrated in FIGS. 7 and 12. A plurality of spring alignment tips 146 extend from the lower surface 144 to engage the springs 115. In addition, a pair of cap retaining tips 152 extend from the lower surface 144 to engage alignment openings 154 formed in the plug body 40 (FIGS. 16E and 16F).

To assemble the lock cylinder 10, the pins 113 and spring 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 103 and the spring-loaded locking bar 94 into the locking 5 bar recess 106, with the gear teeth 136 engaging the locking bar-engaging grooves 132 formed in the racks 92.

Figure 3:
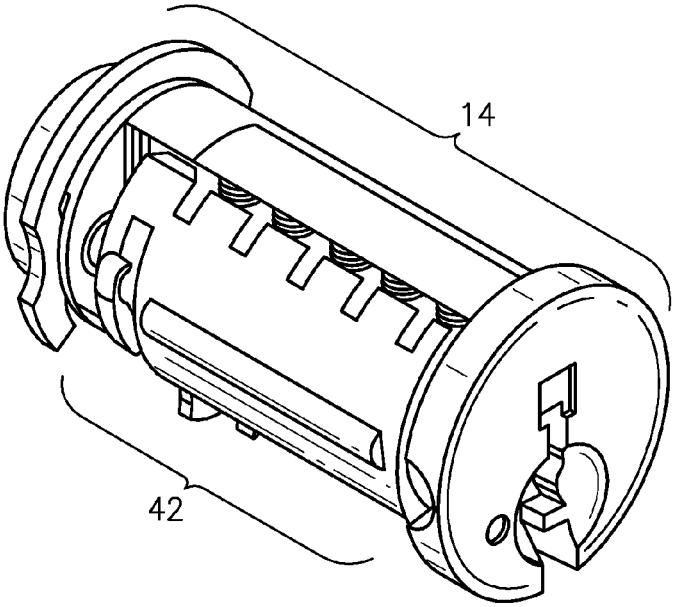
FIG. 3 is a perspective view of a plug assembly illustrating a carrier sub-assembly with a locking bar disposed in a locking position to lock the plug assembly in a lock cylinder body.

The spring catch 96 is disposed in the spring catch recess 108 of the carrier 90. A valid key K is inserted into the keyway opening 52, the return spring 98 is compressed into the return spring recess 112, and the carrier sub-assembly 42 is placed adjacent the plug body 40, as illustrated in FIG. 3. The plug assembly 14 is placed in the cylinder body 12 and the retainer 16 is disposed in the slots 66 formed in the plug body 40 to retain the plug assembly 14 in the cylinder body 12. The lock cylinder 10 is now keyed to the valid key K.

Figure 4:
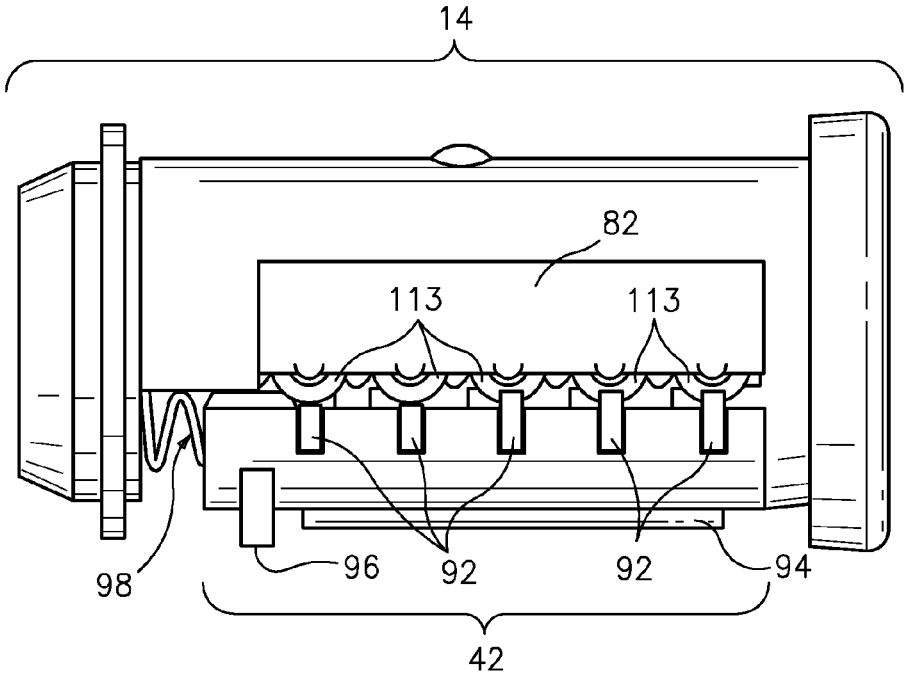
FIG. 4 is a top plan view of the plug assembly of FIG. 3.
Figure 5:
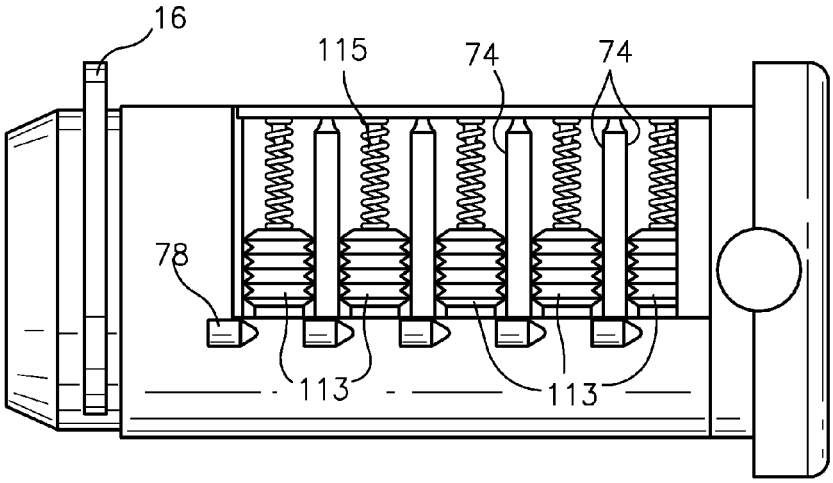
FIG. 5 is a partially broken away side view of the plug assembly of FIG. 3.

The properly keyed lock cylinder 10, without the key K inserted, is illustrated in FIGS. 4-7. The pins 113 are biased to the bottom of the channels 74 and, based on the cut of the key K, the racks 92 are disposed at various positions in the slots 103 of the carrier 90. In this configuration, the locking bar 94 extends from the carrier 90 to engage the groove 29 in the cylinder body 12 to prevent the plug assembly 14 from rotating in the cylinder body 12 and the racks 92 engage the pins 113, as illustrated in FIG. 4. In addition, the bullet-shaped features 78 are misaligned with the recesses 111 in the racks 92 and therefore interfere with movement of the racks 92 parallel to the longitudinal axis A of the lock cylinder 10, which thereby prevents the lock cylinder 10 from being rekeyed.

Figure 8:
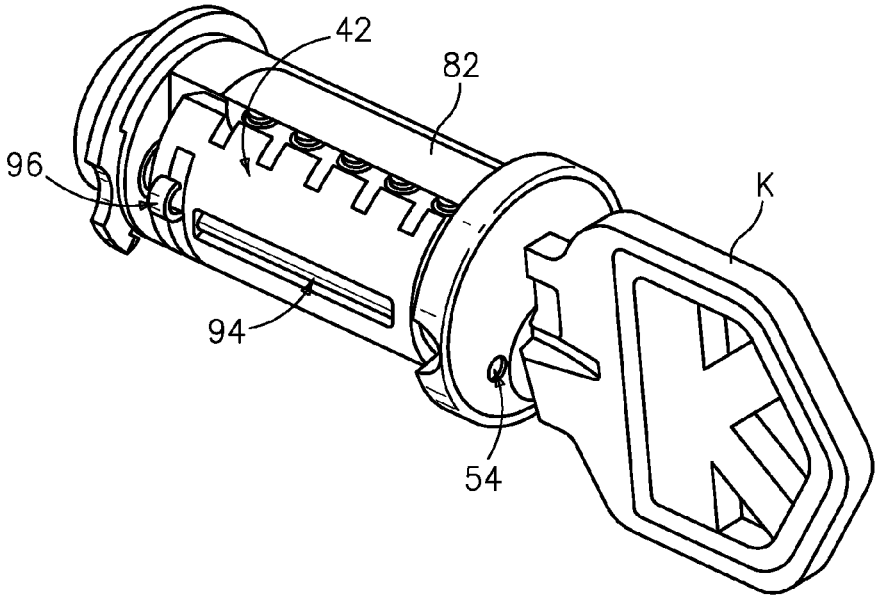
FIG. 8 is a perspective view of the plug assembly of FIG. 3 with a valid key inserted therein and illustrating the locking bar disposed in an unlocking position to allow the plug assembly to rotate in the lock cylinder body.
Figure 9:
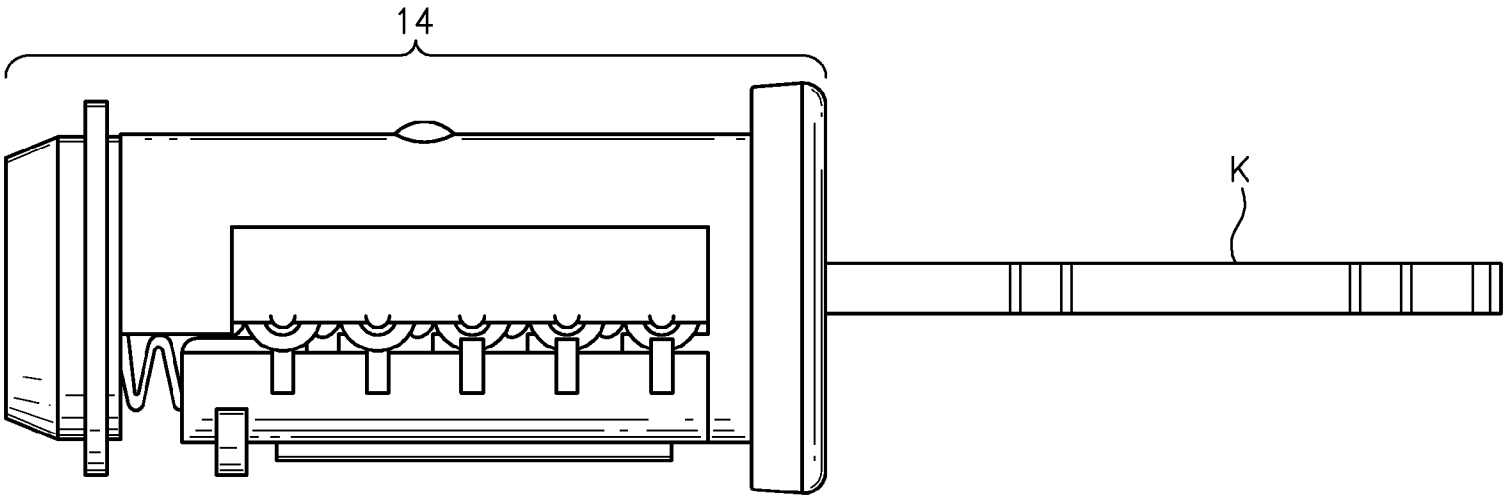
FIG. 9 is a top plan view of the plug assembly of FIG. 8.

The internal configuration of a lock cylinder 10 with the valid key K inserted therein at the home position is illustrated in FIGS. 8-12. In this configuration, the locking bar 94 is free to cam out of the groove 29 in the cylinder body 12, as depicted in FIGS. 8, 9 and 12. The bits of the key K lift the pins 113 in the channels 74 and thereby re-position the racks 92 in the slots 103. When repositioned, the racks 92 are disposed to align the locking bar-engaging grooves 132 with the extended gear teeth 136 on the locking bar 94. The locking bar 94 is free to cam out of the groove 29 as the key K is rotated. At the same time, the bullet-shaped features 78 are aligned with the recesses 124 in the racks 92, as illustrated in FIG. 12, allowing the racks 92, and the carrier 90, to move parallel to the longitudinal axis of the lock cylinder 10.

Figure 13:
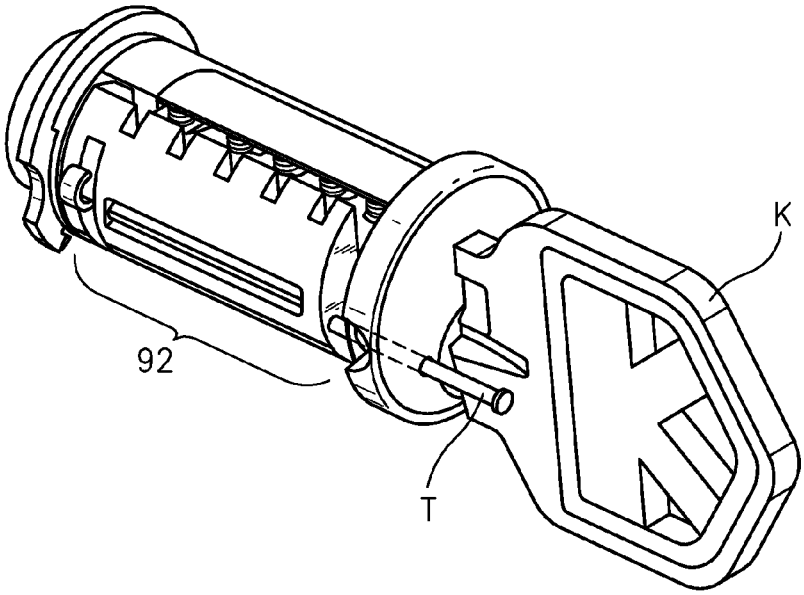
FIG. 13 is a perspective view similar to FIG. 8 but with the carrier assembly moved axially to a rekeying position.
Figure 14:
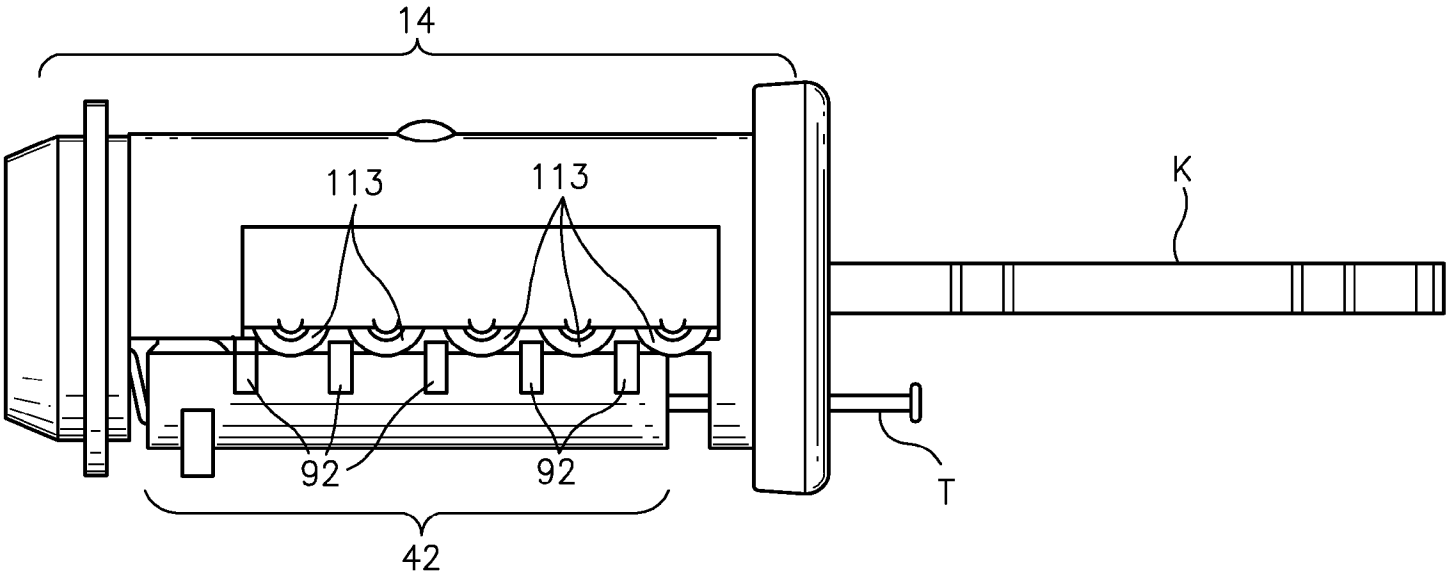
FIG. 14 is a top plan view of the plug assembly of FIG. 13.
Figure 15C:
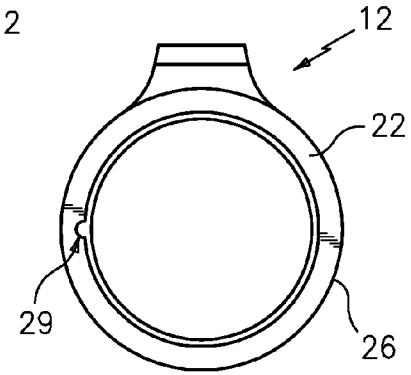
FIGS. 15*a*-15*e* are various views of a cylinder body for use in the present invention.
Figure 15B:
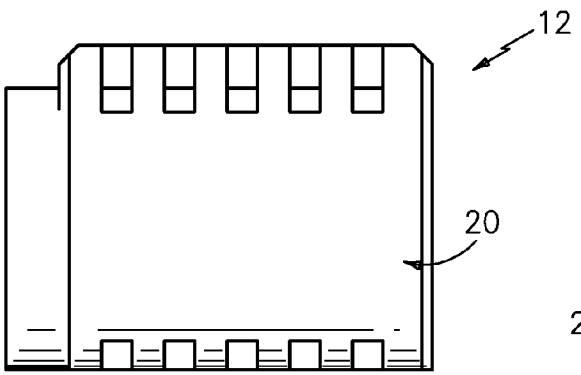
Figure 15A:
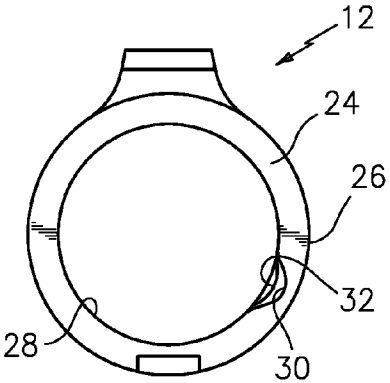
Figure 15E:
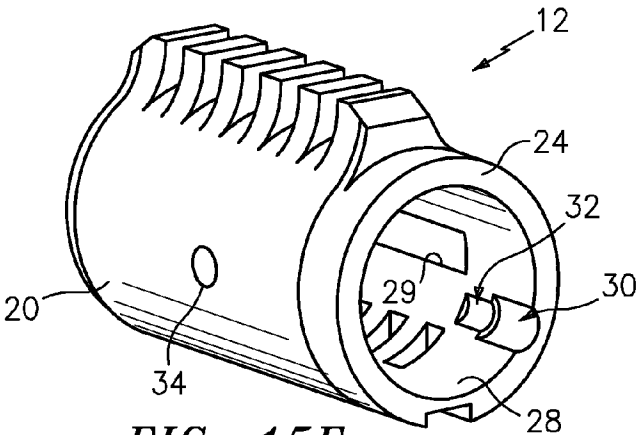
Figure 15D:
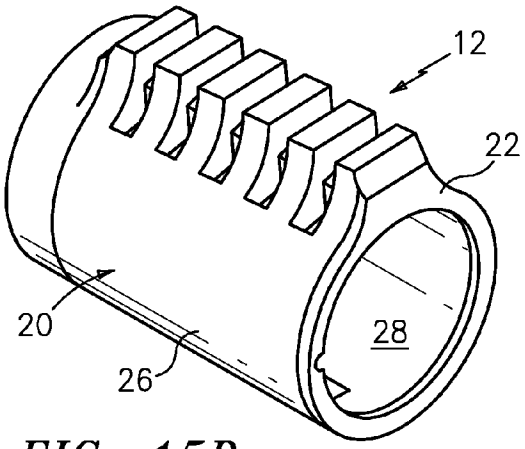

To rekey the lock cylinder 10, the valid key K is inserted into the keyway opening 52, as illustrated in FIGS. 13-14 and rotated approximately 45° counterclockwise from the home position until the spring catch 96 moves into the second detent recess 32 formed in the cylinder body 12. A pointed tool T is inserted into the tool opening 54 and pushed against the carrier 90 to move the carrier 90 parallel to the longitudinal axis of the lock cylinder 10 until the spring catch 96 moves into the first detent recess 30, and the pointed tool T is removed.

With the spring catch 96 disposed in the first detent recess 30, the racks 92 are disengaged from the pins 113, as illustrated in FIG. 14. The valid key K is removed and a second valid key with a different bit arrangement is inserted and rotated clockwise to release the spring catch 96. As the spring catch 96 leaves the first detent recess 30, the carrier 90 is biased toward the plug face 44 by the return spring 98, causing the racks 92 to re-engage the pins 113. At this point, the lock cylinder 10 is rekeyed to the second valid key and the first valid key K no longer operates the lock cylinder 10. The lock cylinder 10 can be rekeyed to fit a third valid key by replacing the first and second valid keys in the above procedures with the second and third valid keys, respectively.

An alternative embodiment of a lock cylinder 200 is illustrated in FIGS. 23-30. The alternative embodiment generally includes the same components as described in the embodiment above, but some of the components have been modified. Functionally, both embodiments are generally the same with the exception that the FIG. 23 embodiment also includes a rekeying feature 300 (FIG. 31) in the plug body 202.

Figure 31A:
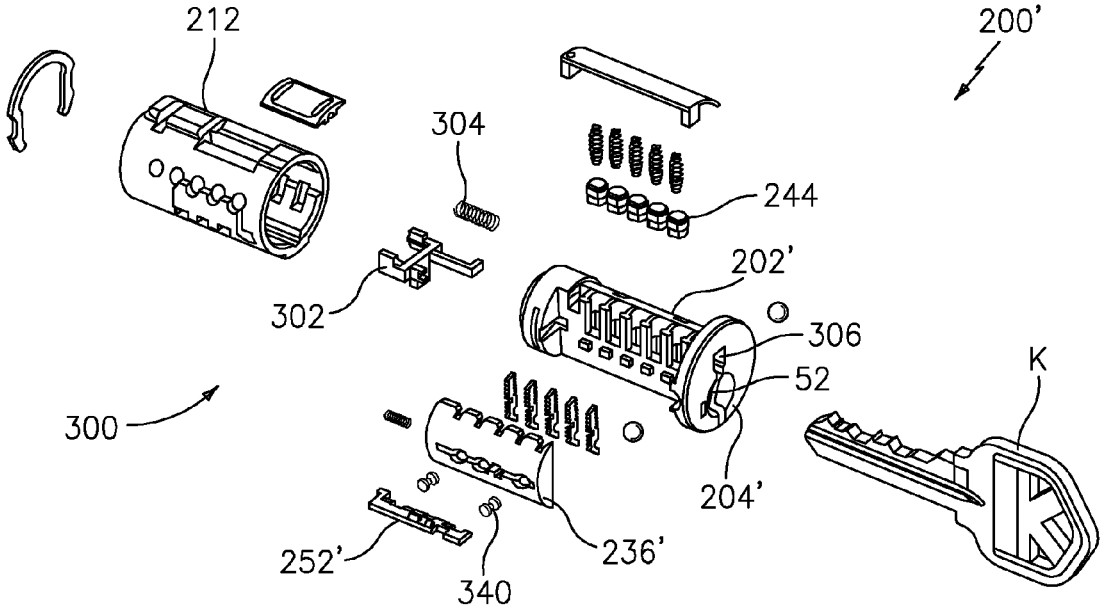
FIGS. 31A-31B are exploded underside perspective views of another alternative embodiment of the present disclosure.
Figure 31B:
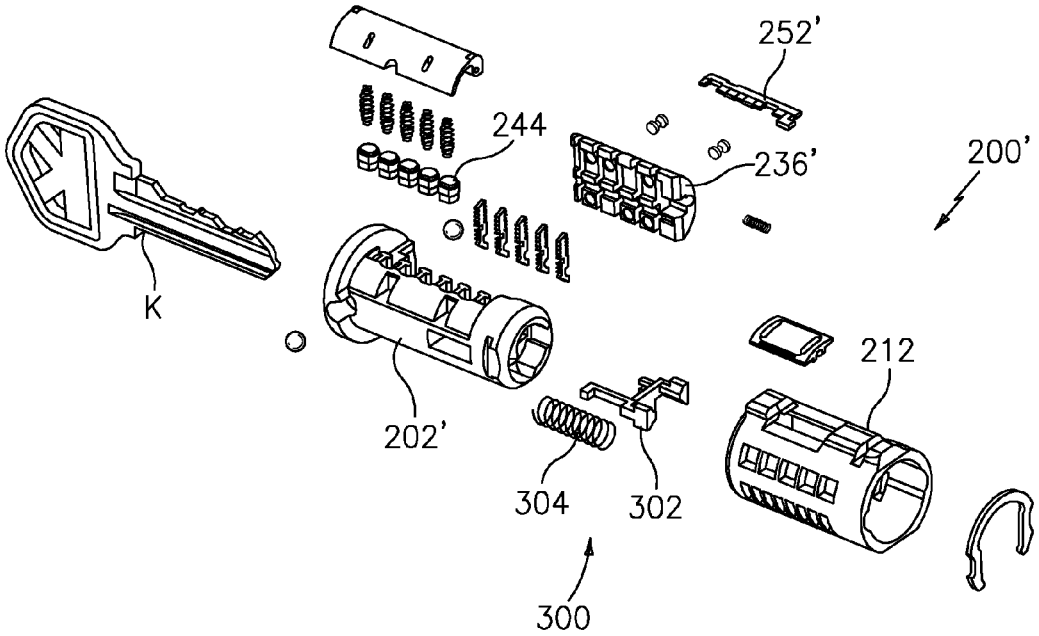
Figure 32A:
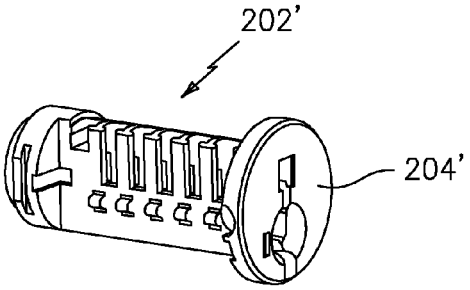
FIGS. 32A-32H are views of a plug body modified for the new rekeying feature.
Figure 32B:
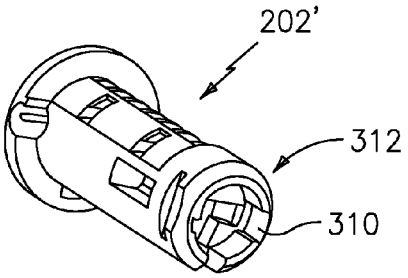
Figure 32C:
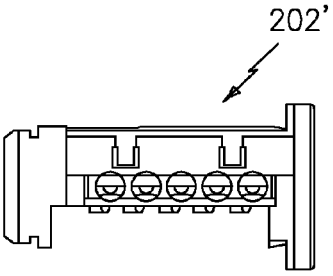
Figure 32D:
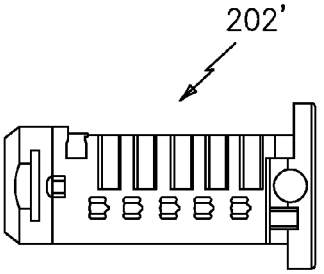
Figure 32E:
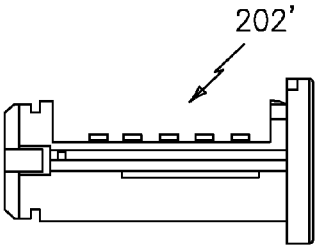
Figure 32F:
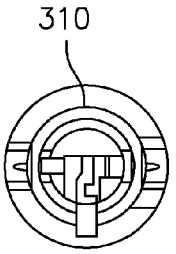
Figure 32G:
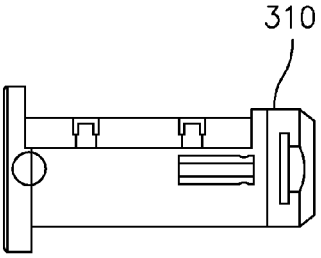
Figure 32H:
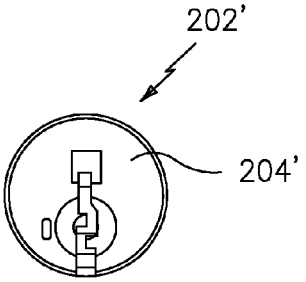
Figure 33A:
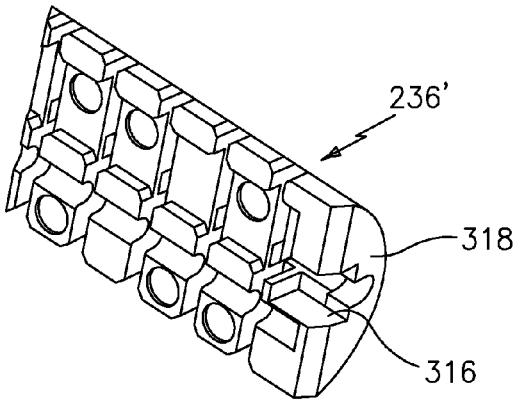
FIGS. 33A-33G are views of a carrier modified for the rekeying feature.
Figure 33B:
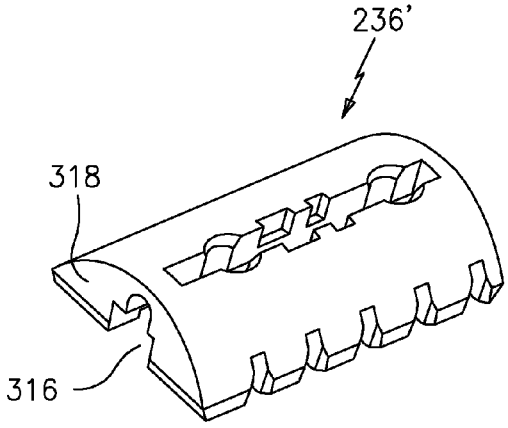
Figure 33C:
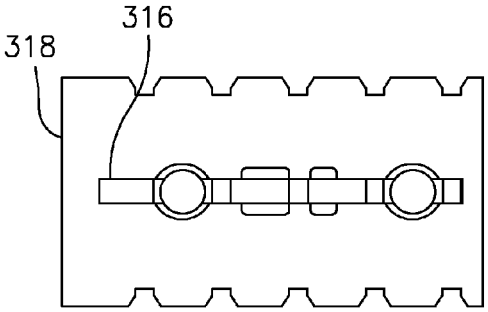
Figure 33D:
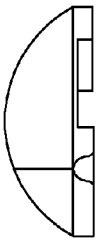
Figure 33E:
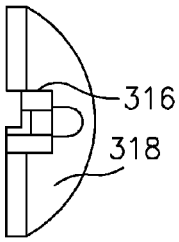
Figure 33F:
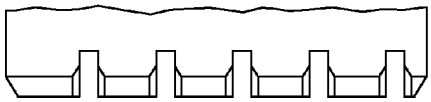
Figure 33G:
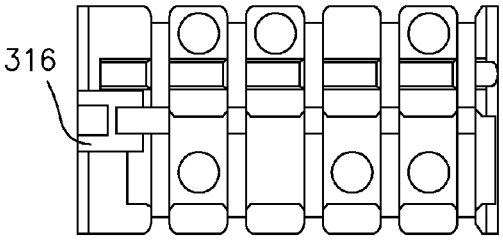
Figure 34A:
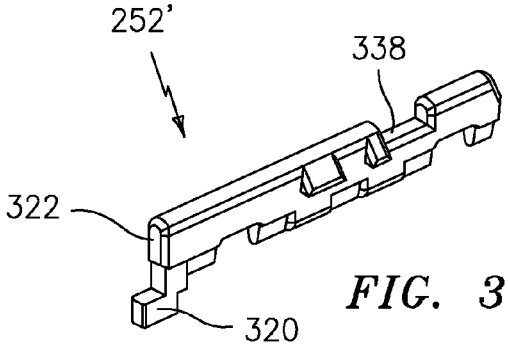
FIGS. 34A-34E are views of a locking bar for the rekeying feature.
Figure 34B:
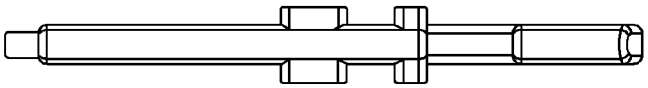
Figure 34C:
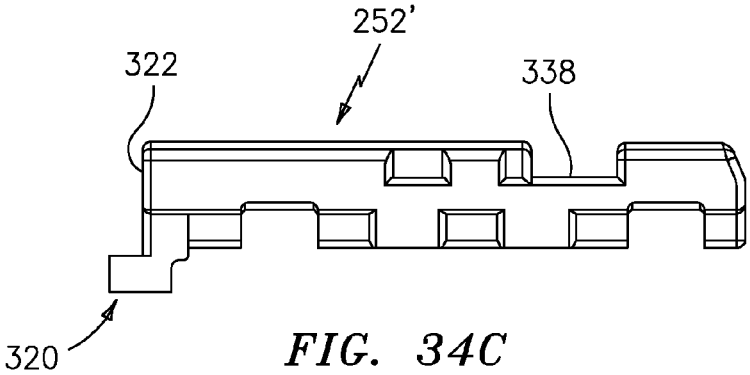
Figure 34D:
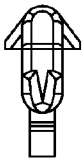
Figure 34E:
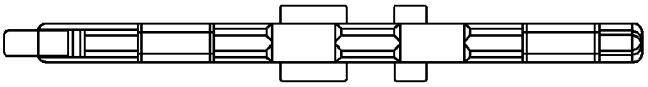
Figure 35A:
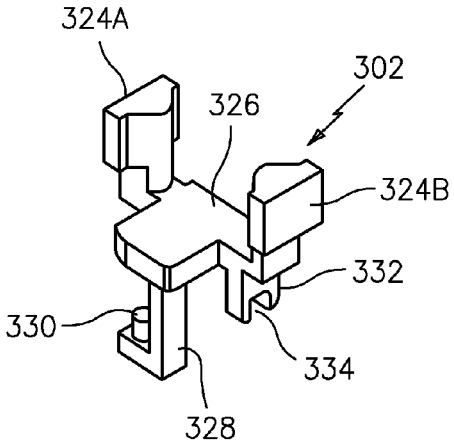
FIGS. 35A-35F are views of a slide for the rekeying feature.
Figure 35B:
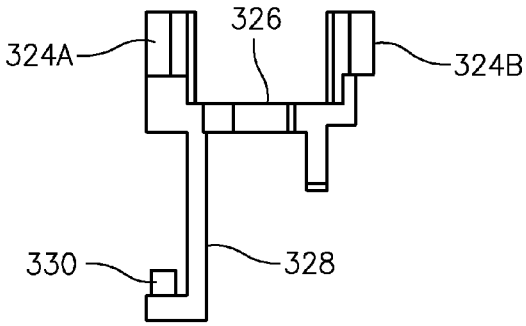
Figure 35C:
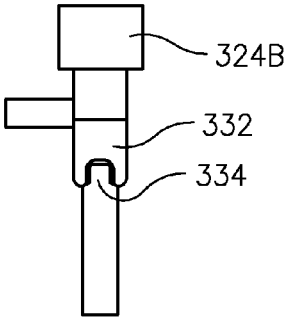
Figure 35D:
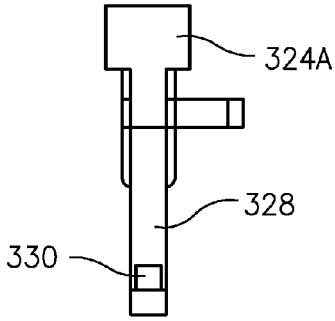
Figure 35E:
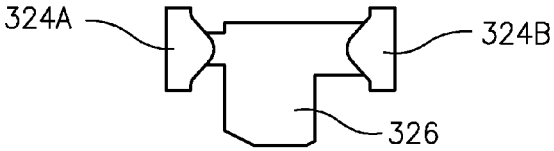
Figure 35F:
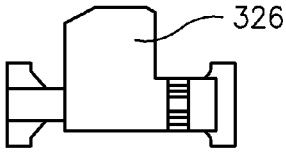

Referring to FIGS. 31A and 31B, a cylinder body 212, illustrated in FIGS. 24A-24D, includes a plurality of apertures 214 running longitudinally along the bottom thereof and a pair of vertical grooves 216, 218 (FIG. 24B) formed in the housing sidewall. In addition, the sidewall includes a removable side panel 220. The rectangular apertures 214 are positioned to allow the use of a manual override tool. The center groove 216 includes an aperture 222 extending through the housing sidewall. The aperture 222 allows a user to move the locking bar 252 during a manual override operation. The side panel 220 also provides access for performing certain operations.

A set of pin biasing springs 226 (also illustrated in FIG. 25) include a non-constant diameter, with the last few coils at each end of the springs 226 having a reduced diameter. The taper allows for a greater spring force in a smaller physical height.

Figure 27A:
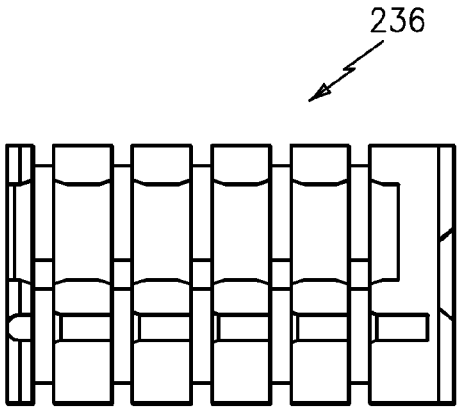
FIGS. 27A-27E are views of an alternative embodiment of the carrier.
Figure 27B:
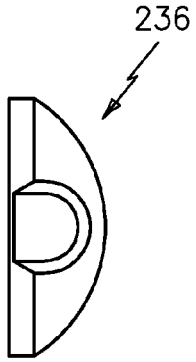
Figure 27C:
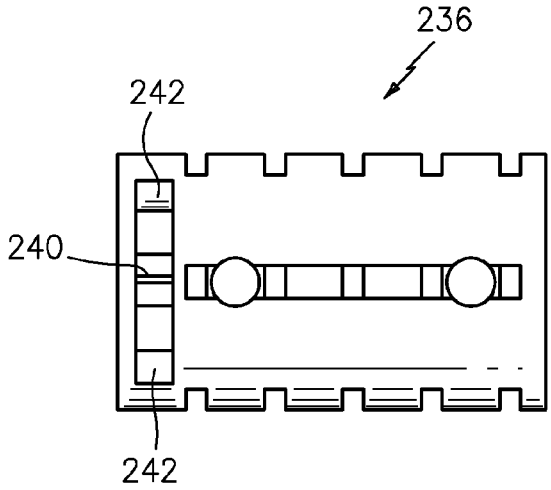
Figure 27D:
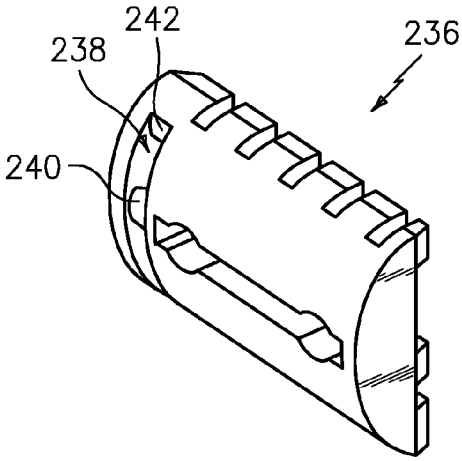
Figure 27E:
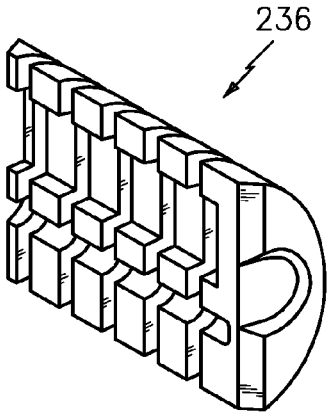
Figure 28A:
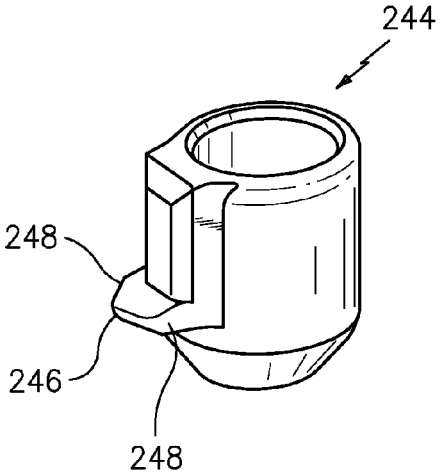
FIGS. 28A-28B are views of an alternative embodiment of the pin.
Figure 28B:
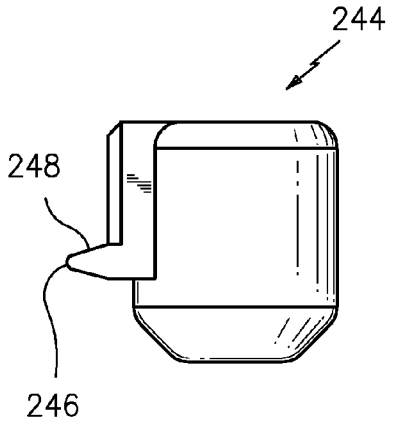
Figure 29A:
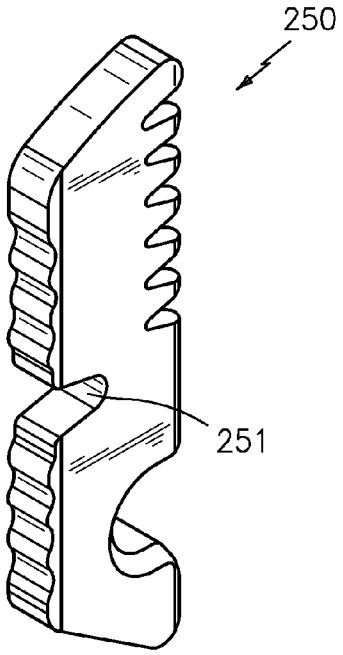
FIGS. 29A-29B are views of an alternative embodiment of the rack.
Figure 29B:
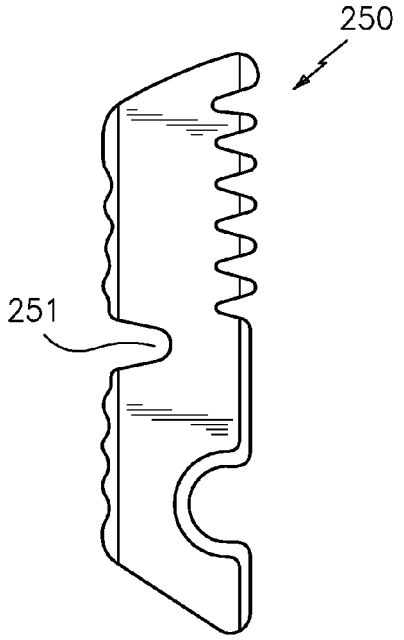
Figure 30A:
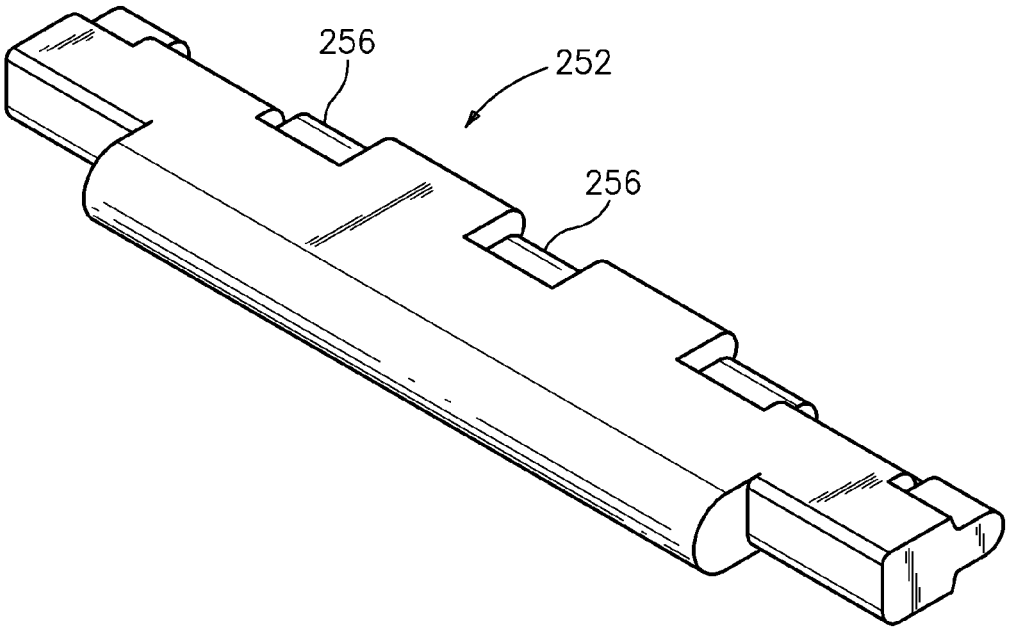
FIGS. 30A-30B are views of an alternative embodiment of the locking bar.
Figure 30B:
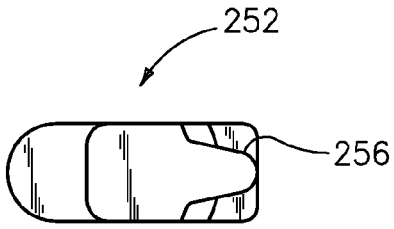

A spring catch 228 (FIGS. 26A-26B) is located inboard of the locking bar 252. The carrier 236 (FIGS. 27A-37E) retains the spring catch 228 in the spring catch recess 238. In the illustrated embodiment, this includes a guide 240 which projects outwardly in the center of the spring catch recess 238 and a pair of anchors 242 radially offset from the guide 240 (FIGS. 27C-27D). The guide 240 prevents the spring catch 228 from moving transversely in the spring catch recess 238 yet permits radial movement outwardly to engage the cylinder body 212 as described above. The anchors 242 engage the arms 232 of the spring catch 228 and prevent the arms 232 from splaying outwardly, thereby directing the compressive force of the spring catch 228 to extend the U-shaped portion 230 outwardly to engage the cylinder body 212.

The pins 244 (FIGS. 28A-28B) include a single gear tooth 246 instead of the plurality of gear teeth of the pins 113 described above. The single gear tooth 246, which includes beveled sides 248, provides for a relatively smoother engagement with the racks during the rekeying process.

The racks 250 (FIGS. 29A-29B) include beveled gear teeth to improve the engagement with the pins during the rekeying process. In addition, the pair of locking bar-engaging grooves 132 in the racks 92 are replaced with a single locking bar-engaging groove 251.

The modified locking bar 252 (FIGS. 30A-30B) is relatively thinner than locking bar 94 and replaces the pair of gear teeth 136 with a single gear tooth 256 and rounds out the triangular edge 134.

Referring to FIGS. 31A and 31B, another alternative embodiment of a lock cylinder 200' is illustrated in FIGS. 31-48. The alternative embodiment generally includes the same components as described in the FIG. 23-30 embodiment above, but some of the components have been modified to include a rekeying feature 300.

The rekeying feature 300 generally includes a modified plug body 202', a modified carrier 236' and a modified locking bar 252' along with two additional components which are a slide 302 and a slide spring 304. The rekeying feature 300 operates to prevent rekeying unless the key K to be learned is fully inserted within the keyway opening 52 and the key K2 is in contact with a keystop 306 in a plug face 204' of the plug body 202' and all of the slots of the new valid key K2 are engaged with the associated pins 244 prior to the new valid key being rotated back to the home position.

Referring to FIGS. 32A-32H, the plug body 202' includes an aft slide opening 310 in the aft end 312 of the plug body 202'. The aft slide opening 310 is generally located in a drive portion of the plug body 202' where the pair of opposed projections 64 (FIG. 16E) were previously located.

Referring to FIGS. 33A-33G, the carrier 236' includes a locking bar extension slot 316. The locking bar extension slot 316 extends through an aft wall 318 of the carrier 236'.

Referring to FIGS. 34A-34E, the locking bar 252' includes an extension 320. The extension 320 is generally L-shaped, extends beyond an end 322 of the locking bar 252' and is laterally displaced therefrom.

Figure 36:
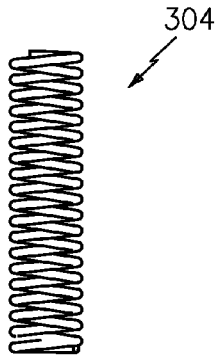
FIG. 36 is a perspective view of a spring for the slide.

Referring to FIGS. 35A-35F, the slide 302 includes a first leg 324A and a second leg 324B connected by a transverse member 326. The longitudinal axis A intersects said transverse member 326 when the slide 302 is installed within the aft slide opening 310 (best seen in FIGS. 32B and 32F). A support arm 328 extends in an opposite direction from the transverse member 326 with respect to the first leg 324A. A spring post 330 extends from the support arm 328 to receive the slide spring 304 (FIG. 36). The slide spring 304 provides a bias to the slide 302 toward the plug face 204'. A block arm 332 extends in an opposite direction from the 25 transverse member 326 with respect to the second leg 324B. The block arm 332 includes an extension slot 334. The extension slot 334 extends longitudinally along the block arm 332 and defines a width great enough to permit passage of the extension 320.

In operation, the rekeying feature 300 assures the key to be learned is properly inserted to avoid a blown cylinder.

To rekey the lock cylinder 200', the current valid key K is inserted into the keyway opening 52, as discussed above.

Figure 37:
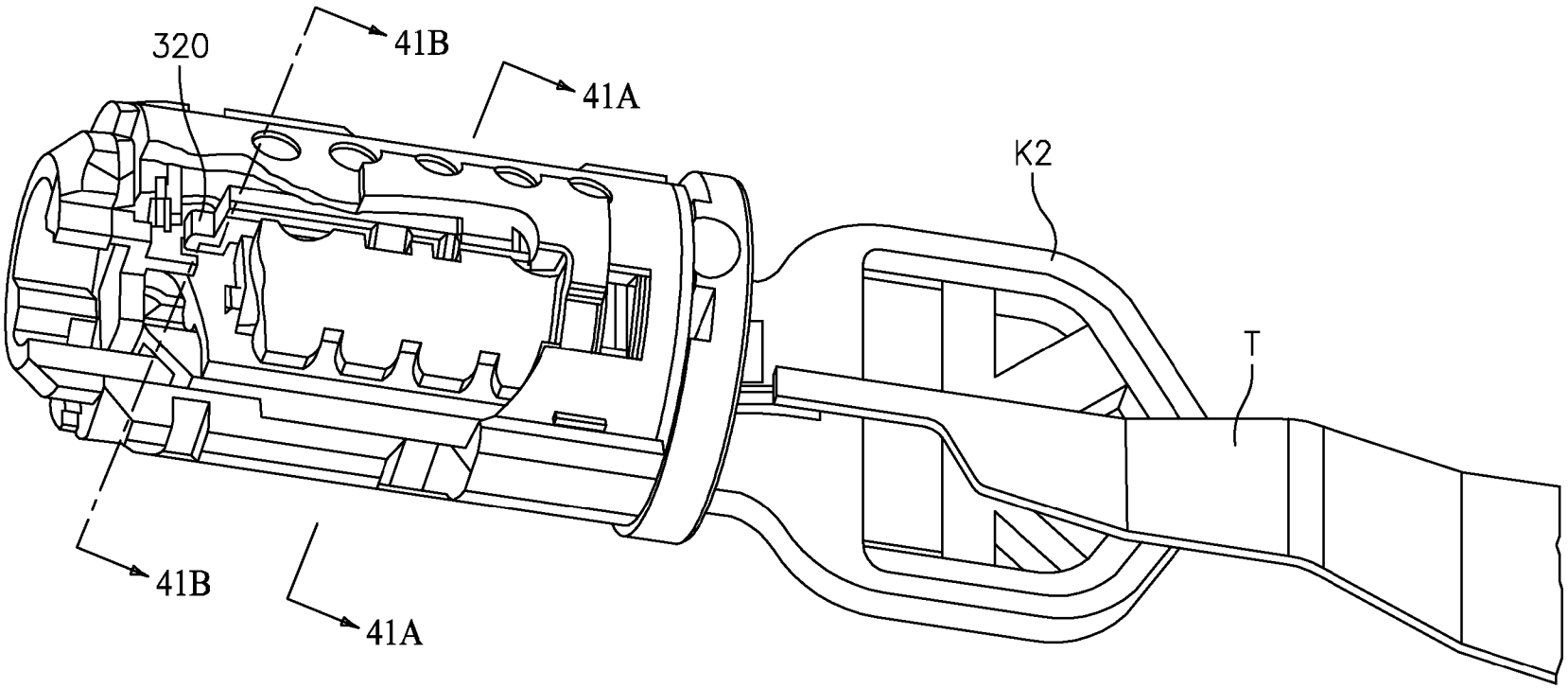
FIG. 37 is a perspective view illustrating rekeying of the lock assembly.
Figure 38:
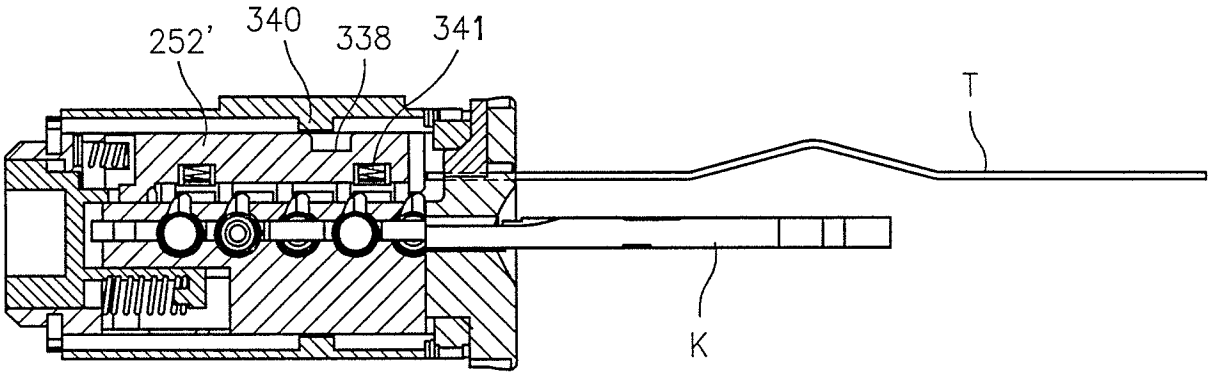
FIG. 38 is a top view of the plug assembly in a rotated position prior to insertion of the pointed tool to shift position of the carrier.

Referring to FIG. 37, with the current valid key K inserted into the keyway opening 52, the plug body 202' may be rotated counterclockwise from the home position to the learn position (FIG. 38). Notably, as the key K is the valid original key, the plug body can only be rotated when the key is fully inserted as with normal lock operation.

Figure 39:
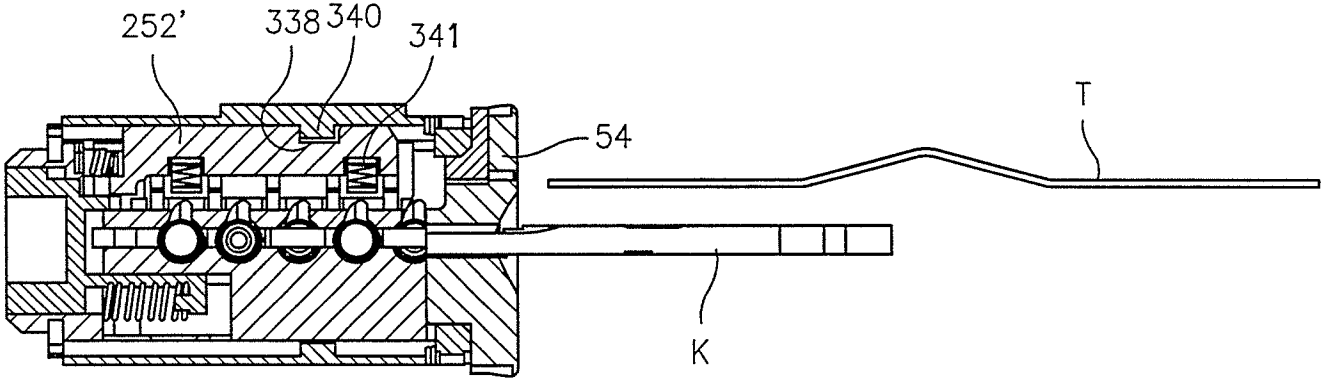
FIG. 39 is a top view of the plug assembly in a rotated position after insertion of the pointed tool to shift position of the carrier, the carrier engaged at a learn position.

Once the plug body 202' is rotated to the learn position which, in one non-limiting embodiment is greater than approximately 29 degrees, a pointed tool T is inserted into the tool opening 54 (FIG. 38) and pushed against the carrier 236 to move the carrier 236 parallel to the longitudinal axis of the lock cylinder 200 as described above. The point tool T is then removed such that the lock cylinder 200' is in a learn mode (FIG. 39). A recess 338 in the locking bar 252' interacts with a feature 340 in the cylinder 212 from the bias of springs 341 to identify and maintain the learn position (FIG. 39). It should be understood that the spring catch 228 and first detent recess 30 as described above may alternately be utilized to identify and maintain the learn position.

Figure 41A:
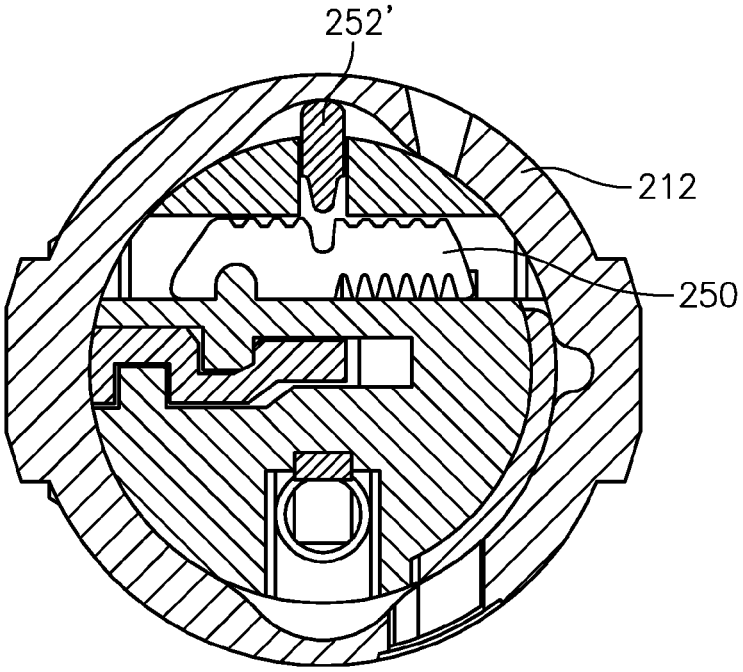
FIGS. 41A, 41B, 42A, 42B, 43A, 43B, 44A and 44B are sectional views as the plug body is rotated from the learning position back to the home position with a second key to be learned fully and 5 properly inserted.
Figure 41B:
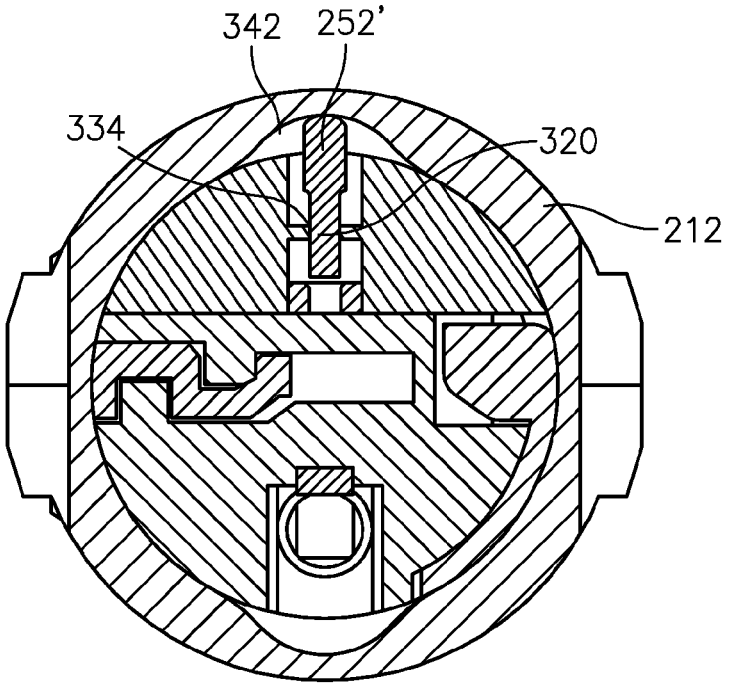
Figure 42A:
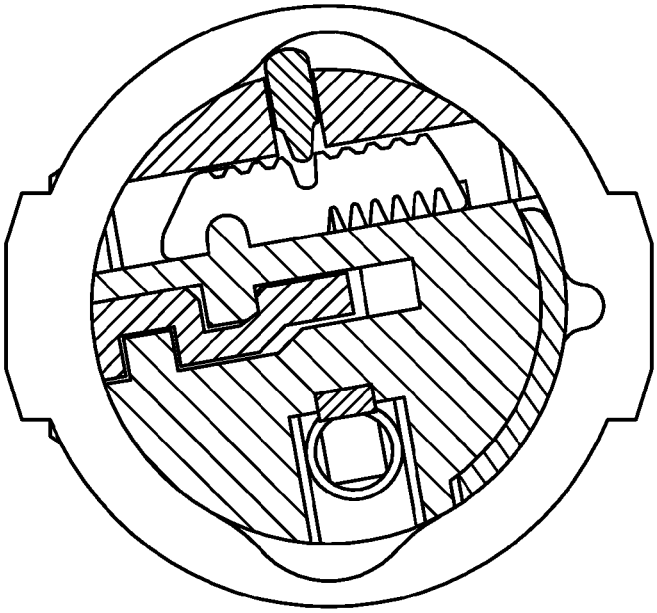
Figure 42B:
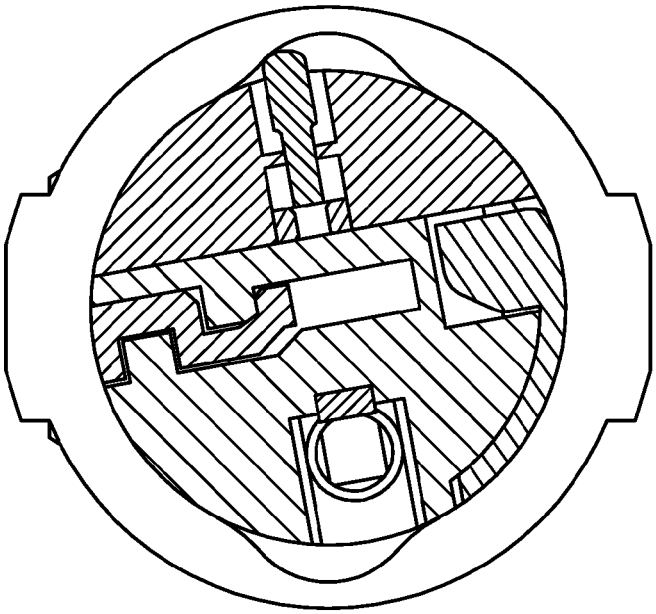
Figure 43A:
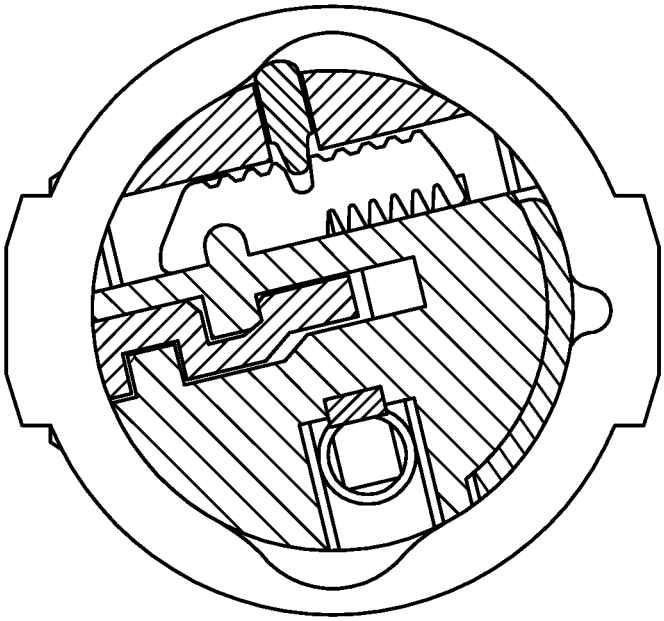
Figure 43B:
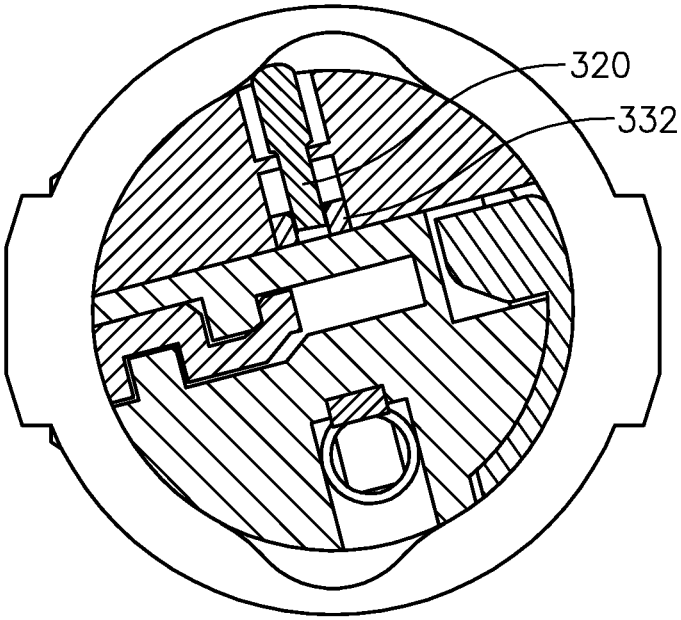
Figure 44A:
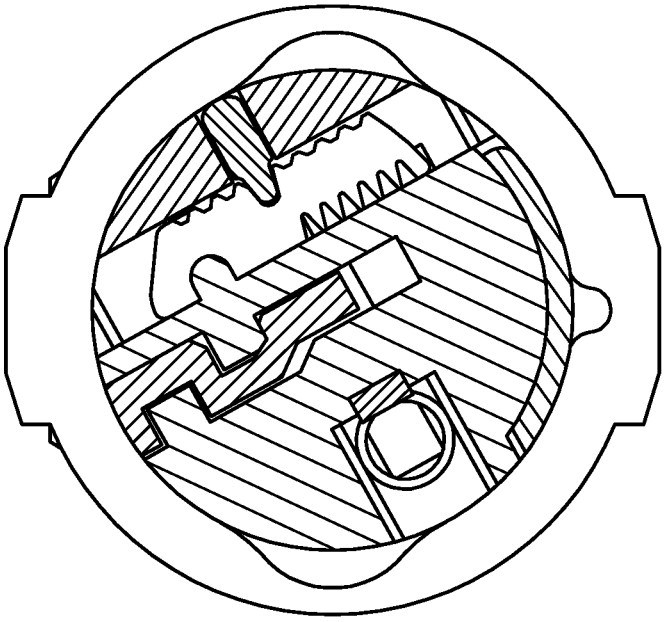
Figure 44B:
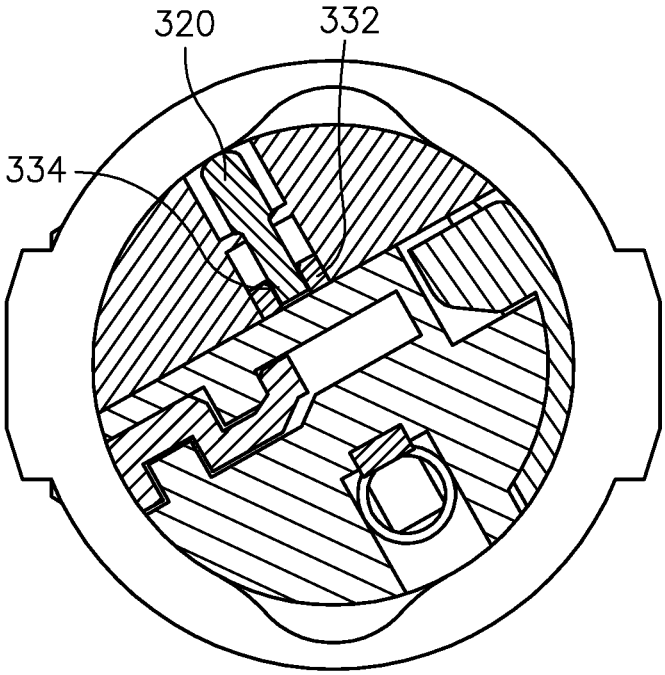
Figure 45:
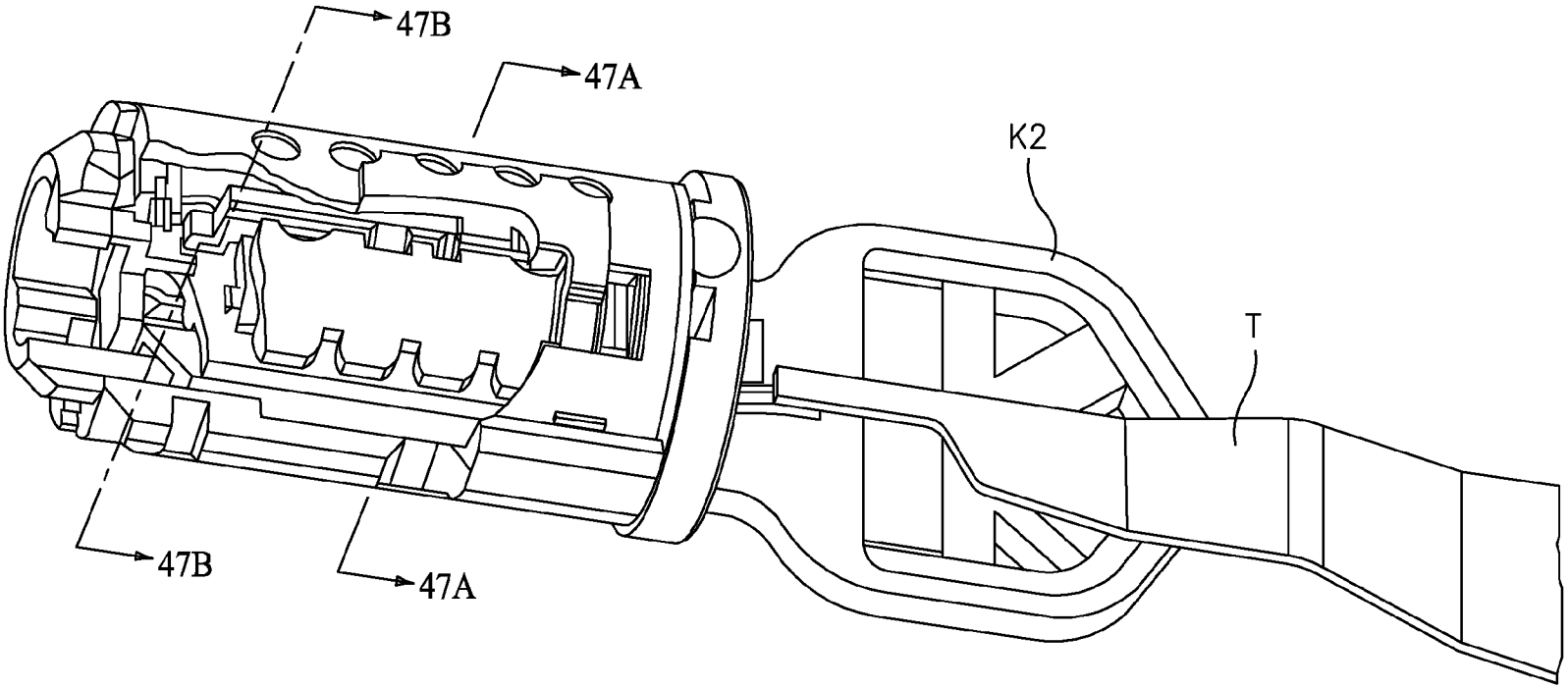
FIG. 45 is a perspective view of lock assembly rekeying with a key to be learned not fully and properly inserted into the keyway opening.
Figure 46:
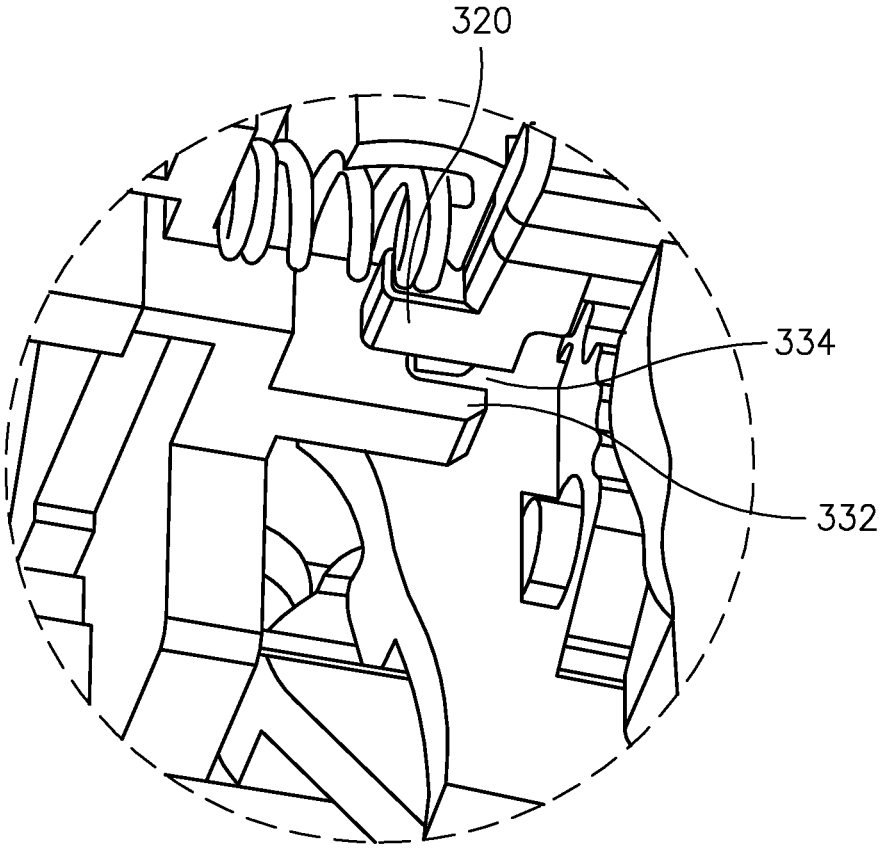
FIG. 46 is an expanded perspective view of the locking bar with a key not fully and properly inserted into the keyway opening illustrating the slide in a position which blocks the locking bar extension.
Figure 47A:
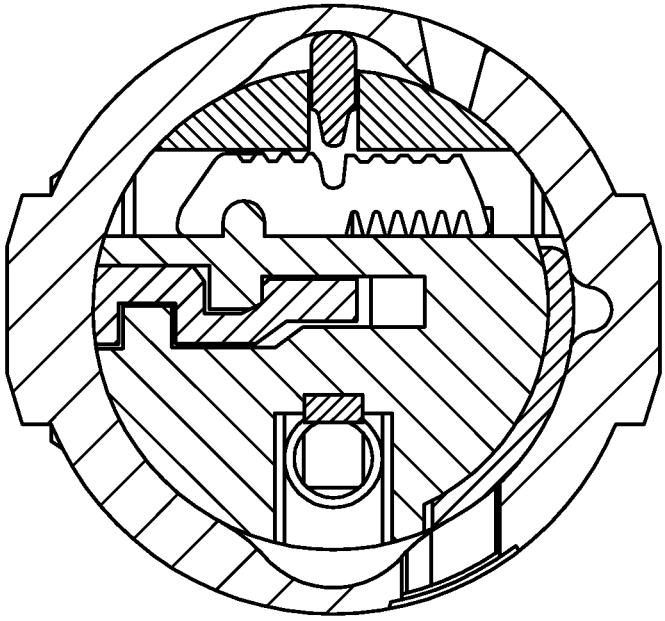
FIGS. 47A, 47B, 48A, and 48B are sectional views as the plug body is rotated from the learning position back to the home position with a second key to be learned not fully and properly inserted such that rotation of the plug body is blocked as the slide is in a position which blocks the locking bar extension.
Figure 47B:
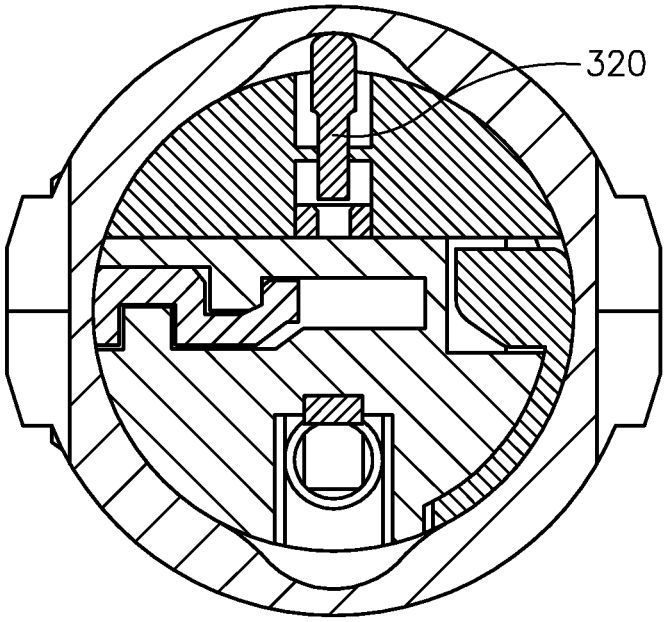
Figure 48A:
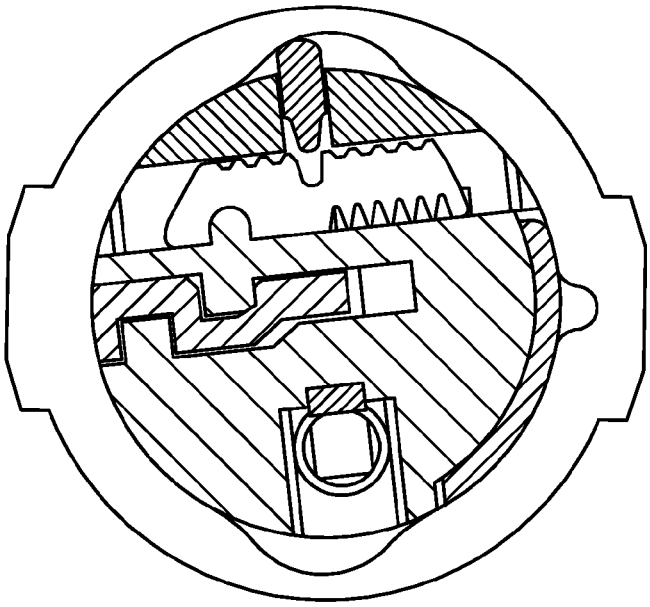
Figure 48B:
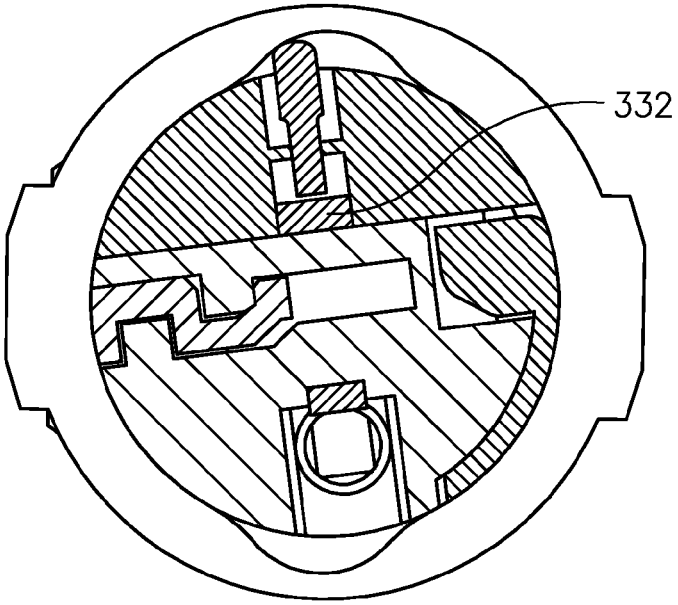

With the feature 340 disposed in the recess 338, the racks 250 are disengaged from the pins 244 as discussed above. The key K is removed and a second key K2 with a different bit arrangement is inserted. Once fully inserted, the second key K2 may be used to rotate the plug body 202' (FIG. 41).

With reference to FIGS. 41-44, rotation of the plug body 202' rides the locking bar 252' within a recess 342 formed within the cylinder body 212. Notably, the recess 342 is set back from the end of the cylinder body 212 as illustrated in the sectional views. As the locking bar 252' rides within the recess 342 when the plug body 202' is rotated back toward the home position, the carrier 236' is released and locking bar 252' is driven radially inward to 25 engage the racks 250 as discussed above. Simultaneously therewith, the extension 320 passes through the extension slot 334. That is, rotation of the plug body 202' is permitted past approximately ten degrees (FIG. 42B) as the second key K2 is fully inserted and the slide 302 is aftwardly located to permit the extension 320 to pass through the extension slot 334 as the plug is rotated and the locking bar 252' is driven radially inward.

Figure 40:
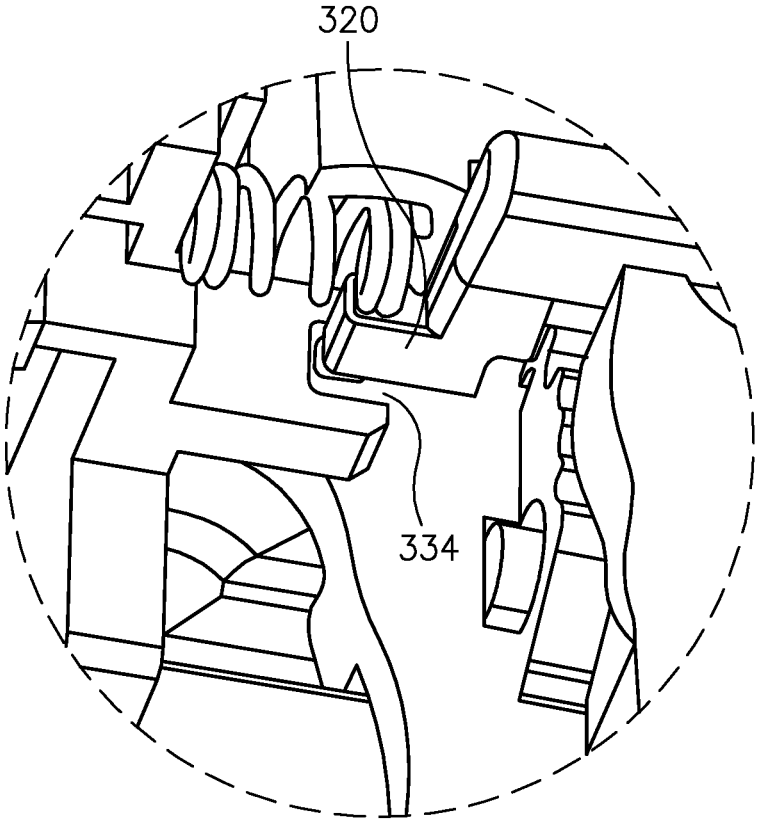
FIG. 40 is an expanded perspective view of the locking bar with a key fully and properly inserted into the keyway opening illustrating the slide in a position which blocks the locking bar extension.

As the second key K2 is fully inserted, the slide 302 is moved aftwardly to align the extension 320 with the extension slot 334 (best seen in FIG. 40). As the second key K2 is fully and properly inserted such that each bit of the second key K2 is engaged, the extension 320 will pass through the extension slot 334 as the plug body 202' is rotated back to the home position (FIGS. 41-44). In other words, the carrier 236' and the locking bar 252' are aftwardly positioned in the learn position such that if the slide 302 is not fully aftward from full and proper insertion of the second key K2, the extension 320 will not pass through the extension slot 334 (FIGS. 45-48).

With reference to FIGS. 45-48, should the second key K2 not be fully inserted into the keyway opening 52 such that each bit of the second key K2 is engaged, the extension 320 cannot pass through the extension slot 334 as the plug body 202' is rotated (best seen in FIG. 46) and the locking bar 252' is driven radially inward. In this condition, the plug body 202' cannot be rotated back to the home position and the lock cylinder 200' cannot be rekeyed through the rekeying process discussed above because the second key K2 is not fully and properly inserted. The condition know as "blown cylinder" is thereby prevented.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A rekeyable lock cylinder comprising:

a plug body with a keyway opening along a longitudinal axis and a multiple of channels transverse to said axis, said plug body having a first position in which said lock cylinder operates and a second position in which said lock cylinder is configured to be rekeyed by a new key insertable in said keyway;

a locking bar generally parallel to said longitudinal axis;

a multiple of racks slidably movable transverse to said longitudinal axis, wherein the locking bar is configured to engage the multiple of racks;

a slide movably mounted to said plug body, said slide having a slot that allows passage of said locking bar if said new key is completely inserted in said keyway such that said plug body may be moved to said first position;

wherein said slide includes a first leg and a second leg, wherein said first leg is not in contact with said second leg, the first and second legs connected by a transverse member;

wherein said slide further comprises an arm extends in an opposite direction from said transverse member with respect to said first leg and said second leg; and a spring post that extends from said arm.

2. The rekeyable lock cylinder as recited in claim 1, wherein said slide is located at an end section opposite a plug face of said plug body.

3. The rekeyable lock cylinder as recited in claim 2, further comprising a spring that biases said slide toward said plug face.

4. The rekeyable lock cylinder as recited in claim 3, wherein a bias of said spring is overcome in response to full insertion of said key into said keyway.

5. The rekeyable lock cylinder as recited in claim 1, wherein said longitudinal axis intersects said transverse member.

6. The rekeyable lock cylinder of claim 1 wherein said locking bar does not pass through said slot if said new key is not completely inserted in said keyway such that said plug body cannot move to said first position.

7. The rekeyable lock cylinder of claim 1 wherein said locking bar has an extension for passing through said slot.

8. A rekeyable lock cylinder comprising:

a cylinder body which defines a longitudinal axis;

a plug body with a keyway opening along said longitudinal axis and a channel transverse to said longitudinal axis;

a carrier disposed adjacent said plug body;

a locking bar mounted at least partially within said carrier generally parallel to said longitudinal axis, said locking bar having an extension;

a multiple of racks slidably movable transverse to said longitudinal axis, wherein the locking bar is configured to engage the multiple of racks; and a slide movably mounted to an end section of said plug body, said slide having a slot that selectively permits passage of said extension depending on whether a rekeying process is successful;

wherein said slide includes a first leg and a second leg, wherein said first leg is not in contact with said second leg, the first and second legs connected by a transverse member, said longitudinal axis intersects said transverse member;

an arm that extends in an opposite direction from said transverse member with respect to said first leg and said second leg; and a spring post which extends from said arm.

9. The rekeyable lock cylinder as recited in claim 8, further comprising a spring that biases said slide toward an end face of said plug body.

10. The rekeyable lock cylinder as recited in claim 9, wherein a bias of said spring is overcome in response to full insertion of a key into said keyway opening during said rekeying process.

11. A rekeyable lock cylinder comprising:

a cylinder which defines a longitudinal axis;

a plug body rotatable within said cylinder;

a multiple of pins movably mountable within said plug body transverse said longitudinal axis;

a multiple of biasing members to bias said multiple of pins toward a keyway;

a carrier mountable adjacent said plug body;

a multiple of racks slidably movable transverse to said longitudinal axis, said multiple of racks engaged with said multiple of pins in response to said carrier being at a first predetermined position, said carrier axially displaceable along said longitudinal axis to selectively disengage said multiple of racks from said multiple of pins in response to said carrier being at a second predetermined position; and a locking bar mounted at least partially within said carrier generally parallel to said longitudinal axis, said locking bar having an extension; and a slide movably mounted to an end section of said plug body, said slide having a slot that selectively permits passage of said extension during a rekeying procedure.

12. The rekeyable lock cylinder as recited in claim 11, wherein said slide includes a first leg and a second leg connected by a transverse member, said longitudinal axis intersects said transverse member;

an arm which extends in an opposite direction from said transverse member with respect to said first leg and said second leg; and a spring post which extends from said arm.

* * * * *